US005286217A

United States Patent [19]

Liu et al.

[11] Patent Number: 5,286,217

[45] Date of Patent: Feb. 15, 1994

[54] ELECTRICAL CONNECTOR WITH IMPROVED LATCH MECHANISM

[75] Inventors: Chao J. Liu, Yuan Lin; Ching-ho Lai, Tu Cheng Hsiang; Jeff Chen, Shin-Jwu, all of Taiwan; Sidney Lu, Sunnyvale, Calif.; Ton-Yo Chien, Pan Chiao, Taiwan

[73] Assignee: Foxconn International, Sunnyvale, Calif.

[21] Appl. No.: 745,609

[22] Filed: Aug. 15, 1991

[51] Int. Cl.[5] ..... H01R 13/62

[52] U.S. Cl. ..... 439/326

[58] Field of Search ..... 439/326–328, 439/630–637, 329, 372

[56] References Cited

U.S. PATENT DOCUMENTS

| | | | |
|---|---|---|---|
| 4,713,013 | 12/1987 | Regnier et al. | 439/326 |
| 4,737,120 | 4/1988 | Grabbe et al. | 439/326 |
| 4,850,892 | 7/1989 | Clayton et al. | 439/326 |
| 4,898,540 | 2/1990 | Saito | 439/326 |
| 4,986,765 | 1/1991 | Korsunsky et al. | 439/326 |
| 4,995,825 | 1/1991 | Korsunsky et al. | 439/326 |
| 5,002,498 | 3/1991 | Takahashi | 439/326 |
| 5,004,429 | 4/1991 | Yagi et al. | 439/326 |
| 5,013,257 | 5/1991 | Korunsky et al. | 439/326 |
| 5,112,242 | 5/1992 | Choy et al. | 439/328 |

*Primary Examiner*—David L. Pirlot

*Attorney, Agent, or Firm*—Flehr, Hohbach, Test, Albritton & Herbert

[57] ABSTRACT

A circuit board latching device (40, 41) for use with an insulative connector housing (31) includes a retaining wall (82) and a circuit board support post (52) in which the board support post (52) is positioned opposite the retaining wall (82). The latching device (40, 41) of the present invention comprises a main body portion (56) and a mounting mechanism for mounting the main body portion to the housing (31) between the retaining wall (82) and the board support post (52). Furthermore, a latch lug (71) extends from the main body portion (56) which includes a cam surface (72) which is inclined relative to the latch lug (71), and a lock surface (73) which is substantially perpendicular to the main body portion (56). Moreover, the latching device (40, 41) includes a resilient stress reducing arm (79) projecting angularly away from the main body portion (56) toward the retaining wall (82). In one aspect, the mounting mechanism comprises a mounting platform (94) which includes a plate (106) extending from the main body portion (56). A first finger (95) extends substantially downward from one end of the plate (106) while a second finger (96) extends substantially downward from the opposite end of the plate (106) which mountingly engage the housing (31). In another aspect of the present invention, the mounting mechanism comprises an upstanding sleeve (59) mounting member extending from the main body portion (56).

39 Claims, 14 Drawing Sheets

30-8
75b-8
71b-8
78b-8
52b-8
56b-8
58b-8
31-8
74b-8
94b-8
107b-8
79b-8
45-8
82b-8
106b-8
109b-8
33-8
43b-8
96b-8
41-8

75b-8
41-8
56b-8
58b-8
106b-8
51b-8
97b-8
108b-8
110b-8
43b-8
31-8
109b-8
107b-8
96b-8
51b-8
94b-8
56b-8
79b-8
30-8

75b-8
79b-8
78b-8
56b-8
106b-8
97b-8
108b-8
58b-8
107b-8
96b-8
94b-8
56b-8
71b-8
42-8

55b-6
78b-6
52b-6
30-6
31-6
74b-6
15
41-6
79b-6
45-6
56b-6
94b-6
43-6
33-6
96b-6

79b-6
41-6
56b-6
94b-6
97b-6
124b-6
31b-6
99b-6
30b-6
106b-6
122b-6
96b-6
98b-6

ELECTRICAL CONNECTOR WITH IMPROVED LATCH MECHANISM

BACKGROUND OF THE INVENTION

1. Field of the Invention

The present invention relates to electrical connectors, and more particularly, to electrical connectors which incorporate a metal latch mechanism.

2. Description of the Related Art

Generally, main circuit boards or "motherboards" employed in computers or other electrical equipment are interconnected to an array of secondary circuit boards. There are numerous types of secondary boards such as edge cards, single in-line packages (SIP), memory modules, a single in-line memory modules (SIMM) or circuit modules. Circuit boards ordinarily comprise a rigid substrate board having a plurality of integrated circuits mounted thereon.

Often, interconnection between a main circuit board and a secondary board is provided through an electrical connector mounted to the main circuit board. These connectors ordinarily include an insulative housing defining an elongated slot which houses a plurality of electrically conductive terminals. The secondary board is inserted into the slot so as to electrically contact the respective terminals. The board is then rotated to its operating position wherein the secondary board generally engages at least two latches disposed on opposing sides of the housing slot. These latches typically provide a contact portion which releasably secures the secondary board in the operational position.

In the past, metal latches have been removably installed at opposing ends of the elongated edge receiving slot in order to secure the secondary board in place.

These earlier metal latches serve as spring members in which bending forces typically are concentrated in a limited region of the latch. Unfortunately, virtually the entire bending forces are absorbed by the latch in that limited region.

Thus, there has been a need for a metal latch for use in an electrical connector which can distribute bending forces experienced by the latch. The present invention meets this need.

SUMMARY OF THE INVENTION

In one aspect, the present invention includes a circuit board latching device for use with an insulative connector housing which includes a retaining wall and a circuit board support post in which the board support post is positioned opposite the retaining wall. The latching device of the present invention comprises a main body portion and a mounting mechanism for mounting the main body portion to the housing between the retaining wall and the board support. Furthermore, a latch lug extends from the main body portion which includes a cam surface which is inclined relative to the latch lug, and a lock surface which is substantially perpendicular to the main body portion. Moreover, the latching device includes a resilient stress reducing arm projecting angularly away from the main body portion toward the retaining wall.

In another aspect of the present invention, the mounting mechanism comprises an upstanding sleeve mounting member extending from the main body portion.

In still another aspect of the present invention, the mounting mechanism comprises a mounting platform which includes a plate extending from the main body portion. First and second fingers extend downward from the plate to engage the housing.

DETAILED DESCRIPTION OF THE PREFERRED EMBODIMENT

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
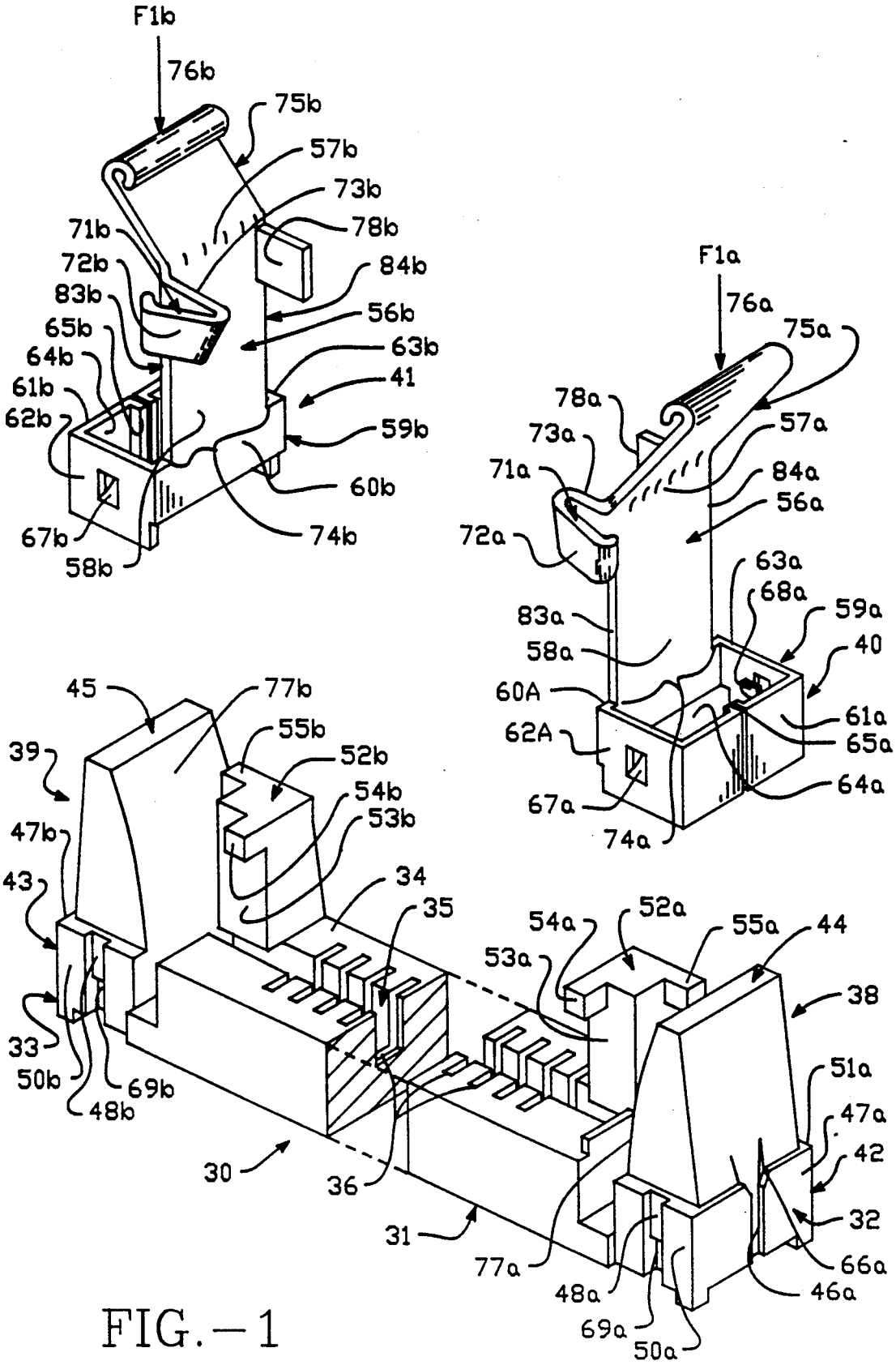
FIG. 1 is a fragmentary, top perspective view of the components of a electrical connector assembly in accordance with the present invention.

It will be noted here that for a better understanding, like components are designated by like reference numerals throughout the various figures. Attention is directed to FIG. 1, where the subject electrical connector, designated 30 is illustrated. In the preferred embodiment, there is shown the connector in accordance with the present invention which comprises an elongated insulative housing 31 including a first housing end 32, an opposing second housing end 33 and a top side 34 which defines a board-edge slot 35 formed in the top side 34. Slot 35 is dimensioned to slidably receive the board-edge device (not shown) of the secondary circuit board (not shown and which forms no part of the present invention). Further, when the secondary circuit board is mounted in its operating position, it will be appreciated that the secondary circuit board lies in a substantially vertical slot plane (not shown) which intersects the housing 31 along the elongated slot 35.

A plurality of electrically conductive terminals 36, are positioned inside slot 35 to engage respective conductive pads (not shown) disposed on the board-edge device. Situated at the first and second opposing housing ends 32 and 33 of the housing 31 and of the elongated slot 35, are a pair of removable latches 40 and 41 which are dimensioned to engage a side edge (not shown) of the secondary circuit board such that the board is releasably secured in its operating position in the slot 35 of the electrical connector 30.

As may be viewed in FIG. 1, a first support post 38, dimensioned to retain a first removable latch 40, upstands from the first housing end portion 32 of housing 31. Similarly, a second support post 39 is dimensioned to retain a second removable latch 41 and upstands from the second housing end portion 33 of housing 31. The respective support posts 38 and 39 comprise a generally rectangular base portions 42 and 43 and respective backstop portions 44 and 45.

Disposed on a respective outermost base rear wall 47*a*, as illustrated in FIG. 1, is a respective guidance slot 46*a*. A similar guidance slot (not visible) is formed in the opposite base near wall 47*b*. Base portions 42 and 43, further, define respective first and second vertical retaining slots 48*a*, 48*b* and 49*a*, 49*b* (not shown) positioned on respective first and second opposing base side walls 50*a*, 50*b* and 51*a*, 51*b* (not shown) of respective base portions 42 and 43.

Figure 2C:
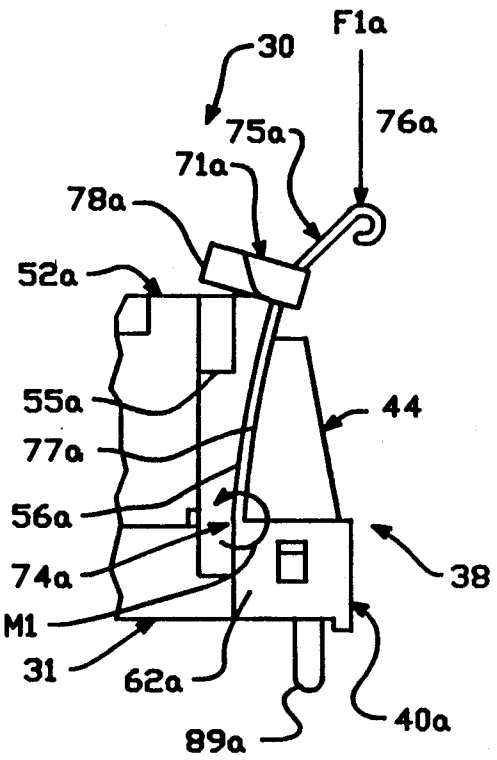
FIGS. 2A through 2C show a series of vertical sectional views of the electrical connector assembly of FIG. 1 at various stages of operation as the removable latch of the present invention is deflected rearward.
Figure 2B:
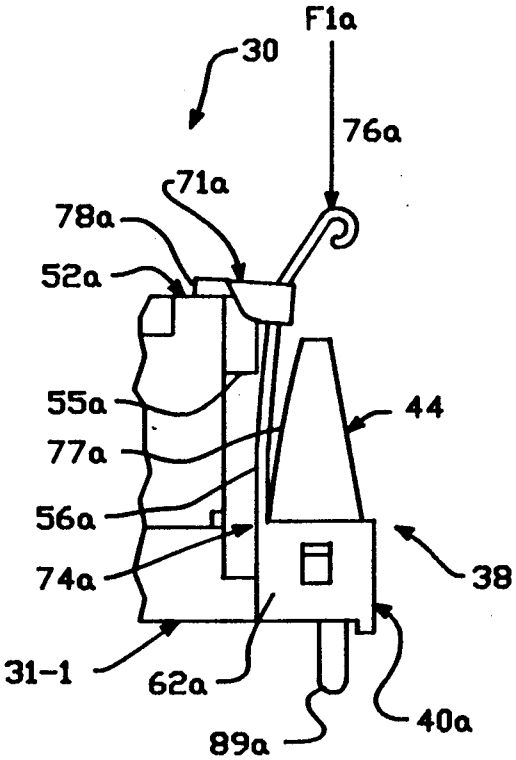
Figure 2A:
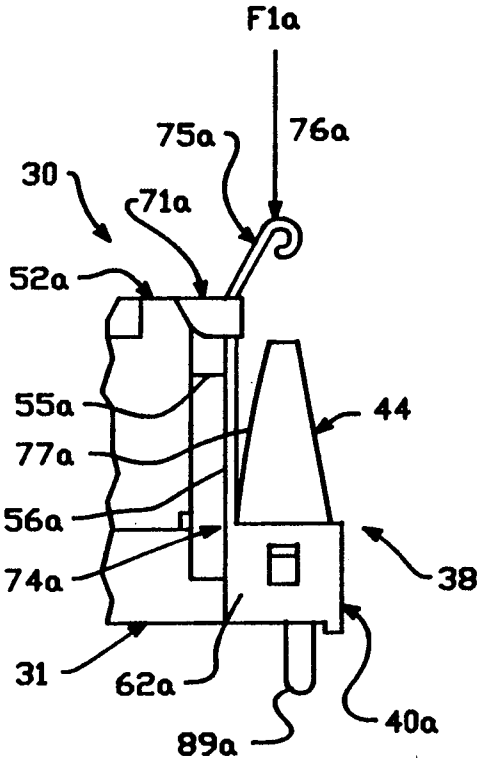

Referring to FIGS. 2A-2C, the electrical connector 30 of the present invention is mounted to the primary circuit board by respective housing mounting posts 89*a* and 89*b* extending downward from the bottom of the respective base portions 42 and 43. The housing mounting post 89*a* is illustrated which is integrally molded into the housing 31 and can extend through a correspondingly dimensioned aperture defined in a primary circuit board (not shown) to allow mounting thereon.

Extending upward from the top side 34 of the housing 31 is a first upstanding rear circuit board support 52*a* which includes a respective substantially vertical wall 53*a* disposed adjacent the board-edge slot 35. As viewed in FIG. 1 the first board support post 52*a* is positioned proximate the first housing end 32, but remains positioned between the first and second support posts 38 and 39. The first board support post 52*a* is substantially rigid and inflexible in response to the forces exerted against the respective vertical wall 53*a* during the secondary circuit board's rotation to its operating position. Thus, the respective vertical wall 53*a* acts as a seat against which the rear face (not shown) of the secondary circuit board rests against while retained in its operating position.

Additionally, protruding perpendicularly outward from the respective vertical wall 53*a*, in a direction perpendicular to the vertical slot plane, is a respective alignment post 54*a*, which is aligned for engaging a correspondingly dimensioned aperture (not shown) through the secondary circuit board. When the respective alignment post 54*a* is inserted into the respective aperture, the alignment post 54*a* causes the secondary circuit board to be both accurately positioned relative to the terminals 36 and to prevent improper or unintended withdrawal from the electrical connector 30.

Projecting outward from the first board support post 52*a* is a respective latch front stop 55*a* which extends in a direction toward the first support post 38. In operation, a portion of the respective first latch 40 will be contacted and prevented from extending beyond the respective latch front stop 55*a*. The respective latch front stop 55*a* prevents the respective first latch 40 from over-extending beyond the stop.

A second board support post 52*b*, substantially symmetrical to the first board support post 52*a*, is positioned proximate the second housing end 33 of housing 31. As can be seen, this mirror-image structure is disposed on the opposite end of the elongated board-edge slot 35 and includes an identical structure which performs the identical functions as the first board support post 52*a*.

As previously mentioned and as can be seen in FIG. 1, the first and second removable latches 40 and 41 are positioned at the respective first and second housing opposing ends 32 and 33, which are, further, disposed at opposite ends of elongated board-edge slot 35. Further, the metal latches 40 and 41 are resilient. Moreover, it will be appreciated that the second latch 41 is symmetrical to, and a mirror-image of, the first latch 40. Henceforth, only the first latch 40 corresponding to the first housing end will be described in detail herein for the ease of description.

The resilient latch 40 comprises a main body portion 56*a* which includes a top portion 57*a*, and a bottom portion 58*a*. Integral with the bottom portion 58*a* is an upstanding rectangular sleeve portion 59*a* which includes a substantially vertical sleeve front wall 60*a*, a sleeve rear wall 61*a* and a respective first and second opposing sleeve side walls 62*a*. As shown, in this first embodiment, the bottom portion 58*a* of the main body 56*a*, is mounted atop the sleeve front wall 60*a*. The respective walls (i.e., the front rear and opposing sides), collectively, define an interior portion 64*a* which is dimensioned to snugly receive the base portion 42 of the support post 38.

Thus, it will be appreciated that upon assembly of the electrical connector 30 of the present invention, the base portion 42 is inserted into the interior portion 64*a* of sleeve portion 59*a*, wherein a respective latch alignment edge 65*a*, which protrudes into the interior portion 64*a* from the sleeve back wall 61*a*, engages the guidance slot 46*a* to assure proper alignment. Moreover, a mouth portion 66*a* of the guidance slot 46*a* is inclined outward so as to facilitate the engagement of the alignment edge 65*a* with the guidance slot 46*a*.

Respective first and second barb members 67*a* and 67*b* are opposingly positioned and protruding into the interior portions 64*a* from the opposing sleeve side walls 62*a* and 63*a*. Further, the barbs 67*a* and 68*a* are positioned to correspondingly engage the respective retainment slots 48*a* and 49*a* which are constructed to reduce the resistance force of the respective first and second barbs 67*a* and 68*a* against the respective first and second base side walls 50*a* and 51*a* during installation.

As illustrated in FIG. 1, the step portions 69*a* and 70*a* are defined by the respective base portion 42 to provide a means for securing the first latches 40 to the insulative first housing end 32. The respective first and second step portions 69*a* and 70*a* are positioned deeper into the base portion 42 which allows the respective barbs 67*a* and 68*a* to retainably engage therewith. Thus, the respective first and second barbs 67*a* and 68*a* slide along the respective retaining first and second slots 48*a* and 49*a* until they engage the respective first and second step portions 69*a* and 70*a*, thereby retaining the latch 40.

Accordingly, after assembly, when the sleeve portion 59*a* snugly engages the base portion 42, the first latch member 40 is removably secured to the housing 31 such that the base portion 42 provides adequate lateral support to retain the secondary circuit board in its operational position in electrical connector 30.

The first latch 40 includes a latch lug 71*a* coupled to a respective first main body edge 83*a* which faces the rotating circuit board. As shown in FIG. 1, the latch lug 71*a* is, further, preferably positioned proximate the top portion 57*a*. The latch lug 71*a* includes a camming wall 72*a*, which is formed to engage the first side edge (not shown) of the secondary circuit board upon rotational assembly, and respective retaining arm 73*a*, which is formed to removably retain the secondary circuit board in its operating position. The substantially planar retaining arm 73*a* extend outward from, and is each substantially perpendicular to, the main body portion 56*a*. Further, the retaining arm 73*a* extends inwardly toward the opposing latch 41, as shown in FIG. 1. The respective camming wall 72*a* is inclined rearwardly at an angle away from distal end of each retaining arm 73*a* in a direction towards the sleeve rear wall 61*a*.

As the secondary circuit board is rotated in the slot 35 to its secured operating position, a first board side edge engages the camming wall 72*a* of the latch lug 71*a*. During engagement, ramping forces urge the main body portion 56*a* rearward in a direction toward the sleeve rear wall 61*a*.

As the main body portion 56*a* is urged rearward, a bending moment is created and is generally concentrated at a resilient spring juncture 74*a*. This spring juncture 74*a* represents the intersection between the main body bottom portion 58*a* and the sleeve front wall 60*a*. Moreover, it will be appreciated that the spring juncture 74*a* is resilient.

As mentioned, upon rotational engagement with the first board side edge of the secondary circuit board, the main body portion 56*a* is deflected rearward until the first board side edge clears the distal end of the retaining arm 73*a*, whereby the spring juncture 74*a* resiliently urges the main body portion 56*a* forward in a direction toward the latch front stop 55*a*. Subsequently, the planar retaining arm 73*a* engages a rear surface of the secondary circuit board, thereby retaining the secondary circuit board in an operating position.

A respective latch plate 78*a* extends outwardly from the main body portion 56*a* in substantially the same direction as the retaining arm 73*a*. However, as shown in FIG. 1, the latch plate 78*a* is coupled to a second main body edge 84*a* of the main body portion 56*a* opposite the first main body edge 83*a*. As best viewed in FIGS. 2A–2C, when the first latch 40 is urged backwards or forwards (i.e., when a secondary circuit board is rotatably installed or removed), the latch plate 78*a* slidably engages a side portion of the latch front stop 55*a* of the first board rear support 52*a*This engagement provides additional guidance to the main body portion 56*a* during movement, as well as providing lateral stability to the latch 23.

Angularly extending away from the top portion 57*a* of the main body portion 56*a* is a cantilever lever 75*a*, as shown in FIG. 1. The cantilever lever 75*a* extends angularly rearward in the direction back toward the retaining portion 44.

Referring back to FIGS. 1 and 2A–2C, a downward force (F1*a*), generally in the direction of arrow 76*a* applied on the cantilever lever 75*a* urges the main body portion 56*a* rearward in a direction toward the rear sleeve wall 61*a*. This retracts the wedge-shaped portion 71*a* from engaging the rear surface of the secondary circuit board; thus permitting the secondary circuit board to be removed from the elongated board-edge slot 35. Moreover, a resistant and opposing bending moment (Ml), shown in FIG. 2(C), acting on the spring juncture 74*a* which urges the main body portion 56*a* back toward the latch front stop 55*a*.

As previously mentioned, a backstop portion 44 is positioned atop the support post 42. As best viewed in FIGS. 1 and 2A–2C, the retaining portion 44 include support backstop wall 77*a* which faces toward the first latch 40. Further, the support backstop wall 77*a* is slightly curved so that when the force (F1*a*) is applied to the cantilever lever 75*a* and the main body portion 56*a* is resiliently urged respectively rearward, it will contact substantially all the support backstop wall 77*a*. Thus, the curved backstop wall 77*a* fits the motion orbit of the main body portion 56 when the same is urged rearward Accordingly, the backstop wall 77*a* prevents the main body portion 56*a* from being over-extended in the rearward direction. This greatly diminishes permanent deformation at the spring juncture 74*a*. Henceforth, each of the next alternative embodiments will only be referenced with respect to one, housing end, 32 or 33, and the respective corresponding latch, 40 or 41, for the ease of description. It will be appreciated, however, that the opposing end is substantially, structurally similar, but is a mirror-image of the described component.

Referring now to FIGS. 3, 4 and 5A–5C, an alternate embodiment of the present invention is illustrated. As shown, a stress reducing arm 79*a*-1 extends downward from top portion 57*a*-1 of the main body portion 56*a*-1. As will be described in greater detail below, the stress reducing arm 79*a*-1 reduces the bending stress concentrated at spring juncture 74*a*-1.

Figure 3:
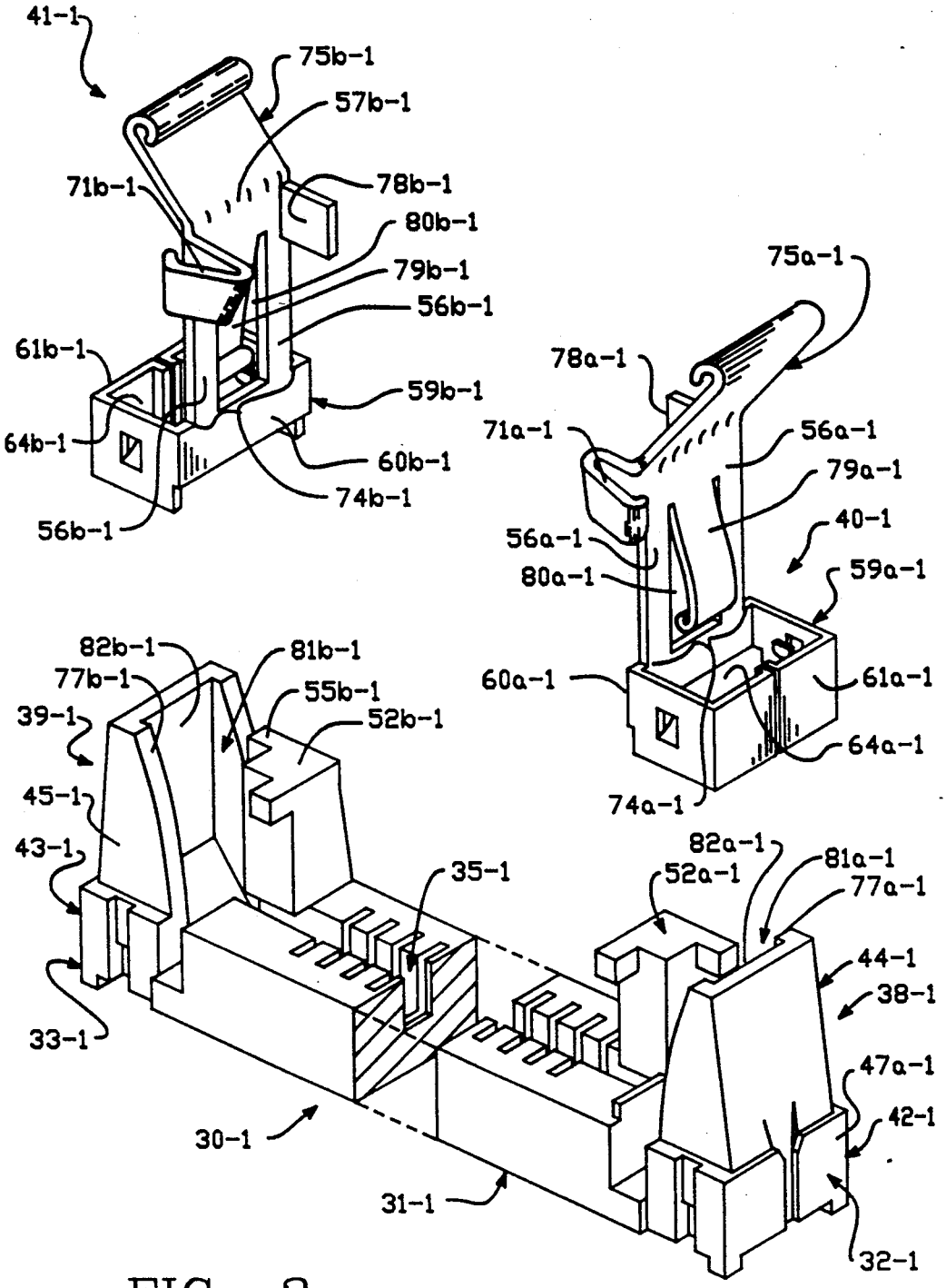
FIG. 3 a fragmentary, top perspective top view of an alternative embodiment of electrical connector assembly in accordance with the present invention illustrating a stress reducing arm.

As best viewed in FIG. 3, the respective moment reducing arms 79*a*-1 and 79*b*-1 preferably are centrally positioned and extend substantially the vertical length of the respective main body portions 56*a*-1 and 56*b*-1. The stress reducing arm 79*a*-1 is angled rearwardly in the direction toward sleeve rear wall 61*a*-1. Further, the main body portion 56*a*-1 defines an arm slot 80*a*-1 in which the stress reducing arm 79*a*-1 is free to extend through during deflection of the main body 56*a*-1.

Figure 4:
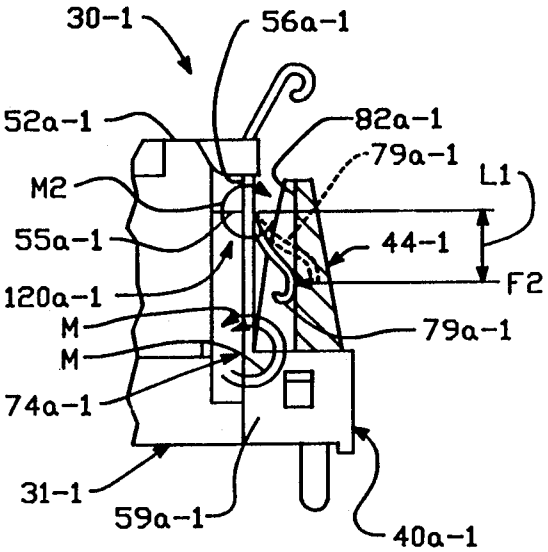
FIG. 4 is a vertical sectional view of the electrical connector assembly of FIG. 3 illustrating the stress reducing arm in the relaxed state.

The support post 42-1 defines an upstanding channel 81*a*-1 including a rear retaining wall 82*a*-1, as shown in FIGS. 3, 4 and 5A–5C. In FIG. 4, the stress reducing arm 79*a*-1 is illustrated in phantom lines to represent its relaxed state. When the respective latch 40-1 is mounted to the respective support post 42-1, the arm engages the retaining wall 82*a*-1 so that it is tensioned by a forces equal to F2. This respective force (F2) creates a secondary bending moment ($M2=F2\times L1$, where L1 is the vertical distance between a first retaining force (F2) and the respective reducing arm juncture 120*a*-1 which is the intersection of the respective main body portion 56*a*-1 and the respective stress reducing arm 79*a*-1) about the respective reducing arm juncture 120*a*-1.

As is best viewed in FIG. 4, the secondary moment about the reducing arm juncture 120*a*-1 is in the direction opposite the primary bending moment (M3) created by the resiliency of the spring juncture 74*a*-1 itself. Collectively, when in the non-tensioned position illustrated in FIGS. 4 and 5(A), the effect of the primary bending moment (M3) is reduced by the oppositely directioned secondary bending moment (M2), forming the collective bending moment ($M4=M3-M2$). The collective moment (M4) about spring juncture 74*a*-1 still retainably urges the respective main body portion 56*a*-1 against the latch front stop 55*a*. However, the force which the main body portion 56*a*-1 abuts the respective latch front stop 55*a* is slightly smaller than if the respective stress reducing arm 79*a*-1 were not present.

More importantly, the stress concentration at the spring juncture 74*a*-1 is reduced and redistributed to the stress concentration created at the reducing arm juncture 120*a*-1 by the secondary bending moment M2). This reduces stress fracturing and metal fatigue at the spring juncture 120*a*-1.

Figure 5C:
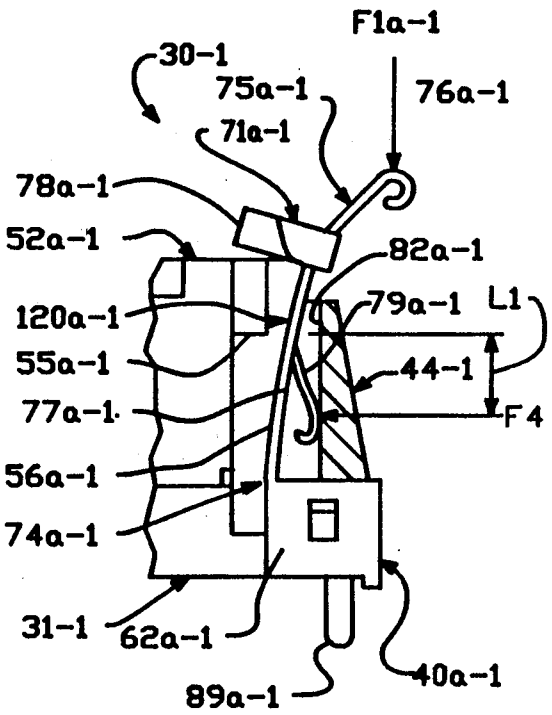
FIGS. 5A through 5C show a series of vertical sectional views of the electrical connector assembly of FIG. 3 at various stages of operation as the removable latch of the present invention is deflected rearward.
Figure 5B:
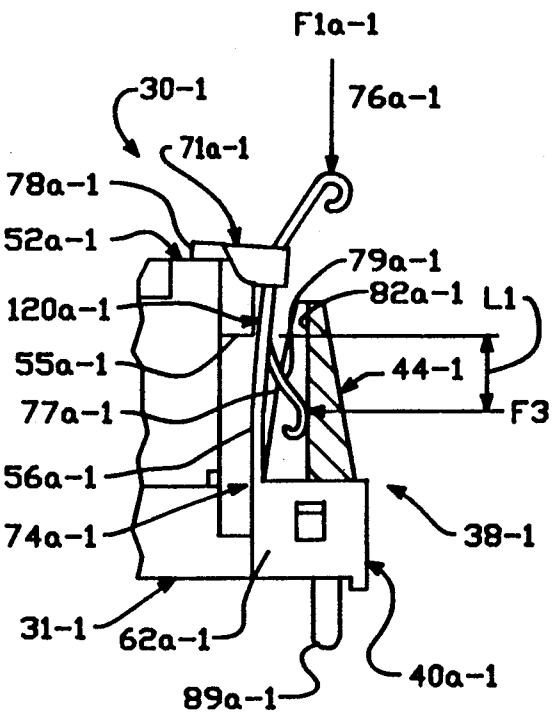
Figure 5A:
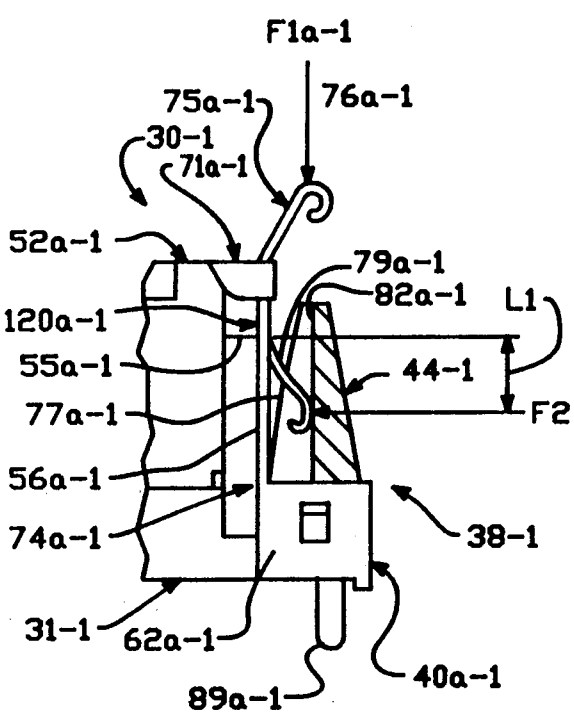

As may be seen in FIGS. 5(B) and 5(C), as the main body portion 56*a*-1 is deflected more rearward, the primary bending moment (not shown), as well as the stress concentration, about the spring juncture 74*a*-1 increases. However, this is offset by secondary bending moment (not shown) created about reducing arm juncture 120*a*-1 as the stress reducing arm 79*a*-1 increasingly engages, by a second and third retaining forces (F3) and (F4), respectively, against the rear retaining wall 82*a*-1 in the direction of the arrow. Accordingly, the stress concentrated at spring juncture 74*a*-1 is reduced proportionately.

In an alternative embodiment employing the stress reducing arm 79*a*-1 of the removable latch 40-1 of the present invention, two respective stress reducing arms (not shown) may be provided which extend downward from the respective top portion 57*a*-1 of the main body 56*a*-1. Although this specific embodiment is not show with respect to this particular mounting mechanism, the concept of dual stress reducing arms latch may best be illustrated in FIG. 22, which represents still another alternative latch embodiment 40-10 which will be discussed below. However, for the present purpose, it can be shown that the main body portion 56*a*-10 is centrally positioned while the respective reducing arms 79*a*-10 are positioned on opposing adjacent ends of the main body portion 56*a*-10. It will be appreciated that in this embodiment, the primary bending moment will now be created by the dual stress reducing arms 79*a*-10 while the secondary bending moment will be created by the main body portion 56*a*-10. Moreover, it will be appreciated that the retaining rear wall 82*a*-10 (not shown) will similarly oppose the respective dual stress reducing arms 79*a*-10, but will be positioned on the outer opposing edges of retaining portion 44-10 to allow engagement thereof.

Figure 6:
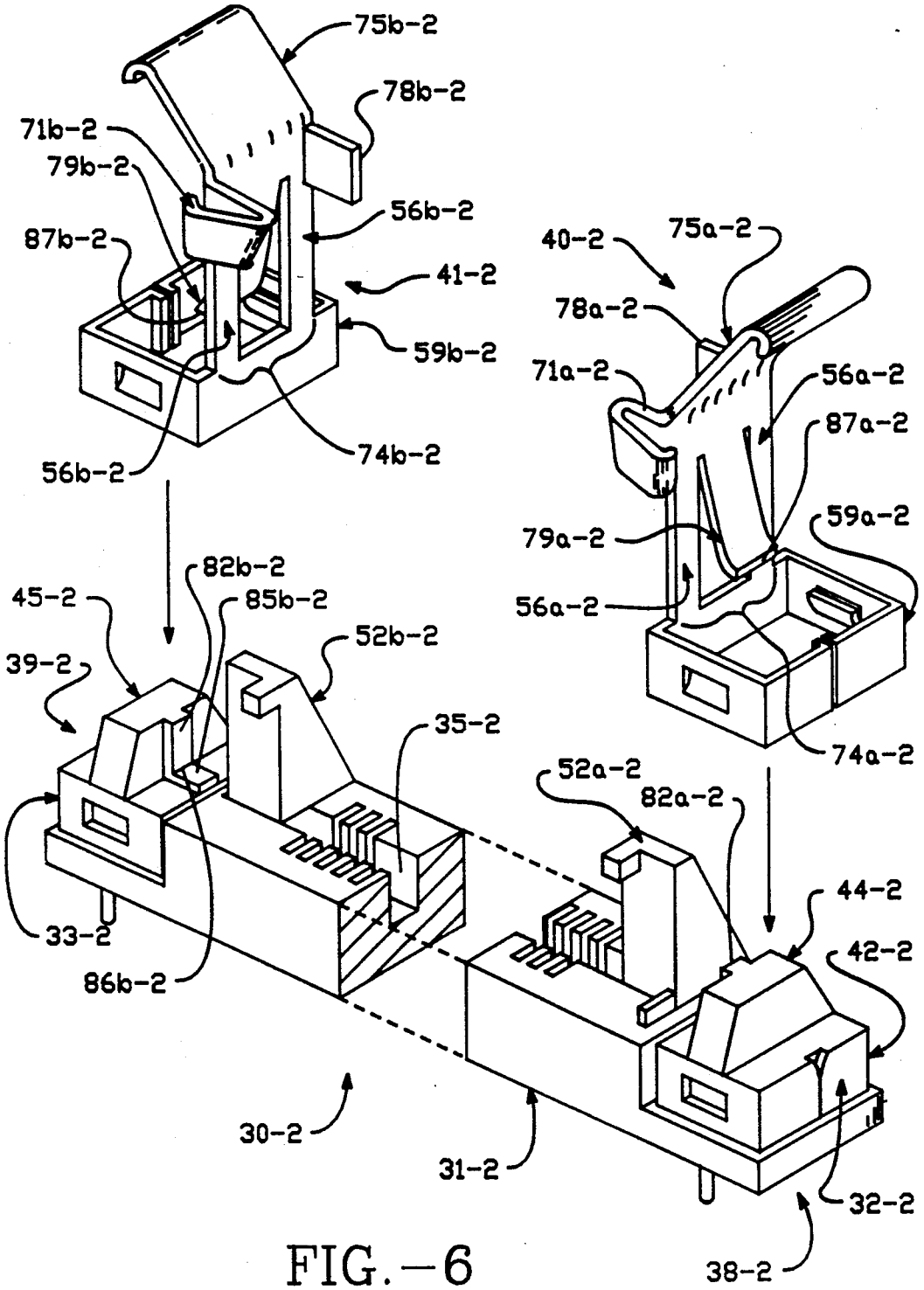
FIG. 6 is top perspective view of another embodiment of the electrical connector assembly of the present invention employing an alternative stress reducing arm.
Figure 7A:
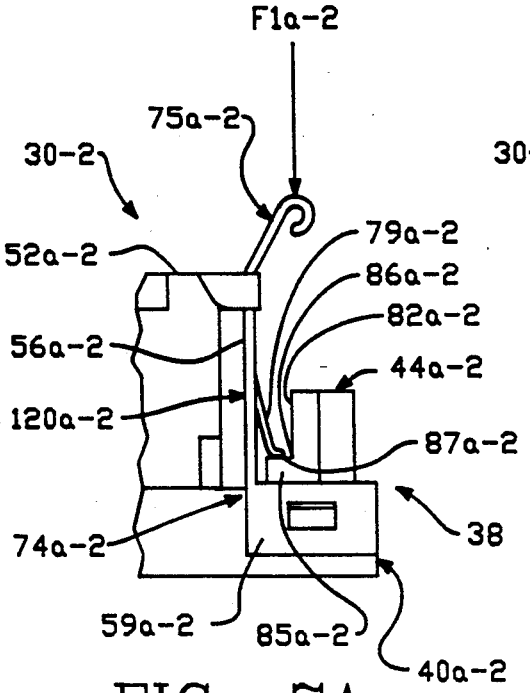
FIGS. 7A through 7C show a series of vertical sectional views of the electrical connector assembly of FIG. 6 at various stages of operation as the removable latch of the present invention is deflected rearward.
Figure 7B:
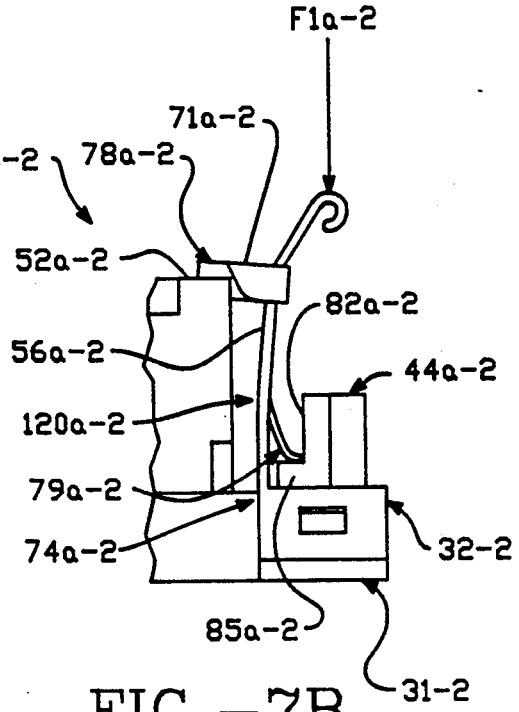
Figure 8:
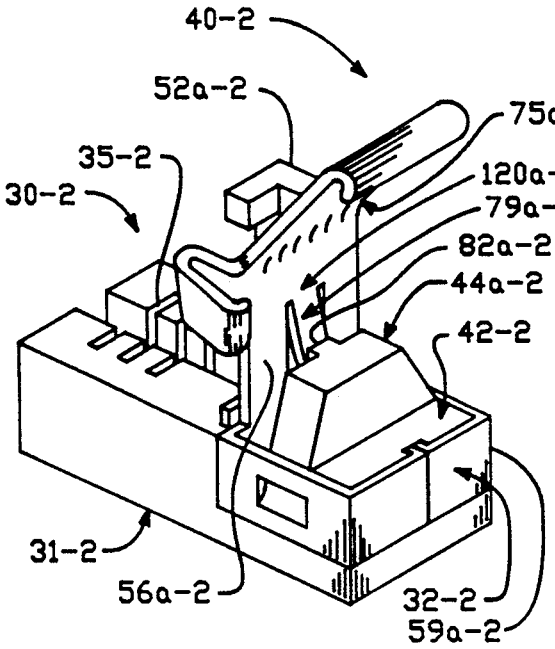
FIG. 8 is a fragmentary, top perspective view of the electrical connector assembly of FIG. 6 releasably mounting a removable latch of the present invention.
Figure 7C:
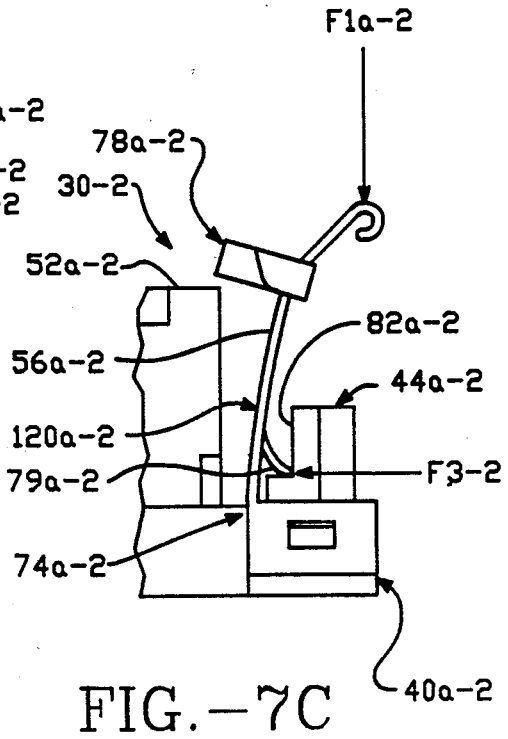

Referring now to FIGS. 6–8, another embodiment of the reduced stress arm 79*a*-2 is illustrated. In this embodiment, the arm 79*a*-2 contacts the retaining wall 82*a*-2 at a respective arm distal end 87*a*-2, as opposed to the mid-portion of the arm 79*a*-1, as occurs in the previous embodiment. As best viewed in FIGS. 7(A–C), the retaining wall 82*a*-1 protrudes outward toward the latch 40-2 from the retaining portion 44-2. A retaining step 85*a*-2 upstands from the base portion 42-2, and further, is adjacent to the protruding retaining wall 82*a*-2.

As shown in FIGS. 7(A) and 8, when the respective latch 40-2 is in a non-tensioned state, the distal end 87*a*-2 of the stress reducing arm 79*a*-2 abuts the retaining step 85*a*-2 which urges the main body portion 56*a*-2 forward up against the latch front stop 55*a*-2. However, as a downward force (F1*a*-2) is applied to the cantilever lever 75*a*-2, the arm distal end 87*a*-2 slides respectively rearward into a retaining juncture 86*a*-2 formed the intersection between the retaining wall 82*a*-2, and the retaining step 85*a*-2. Thus, engagement with the retaining juncture 86*a*-2 permits the stress reducing arm 79*a*-2 to create the oppositely directioned secondary bending moment (not shown) about at the reducing arm juncture 120*a*-2.

Figure 9:
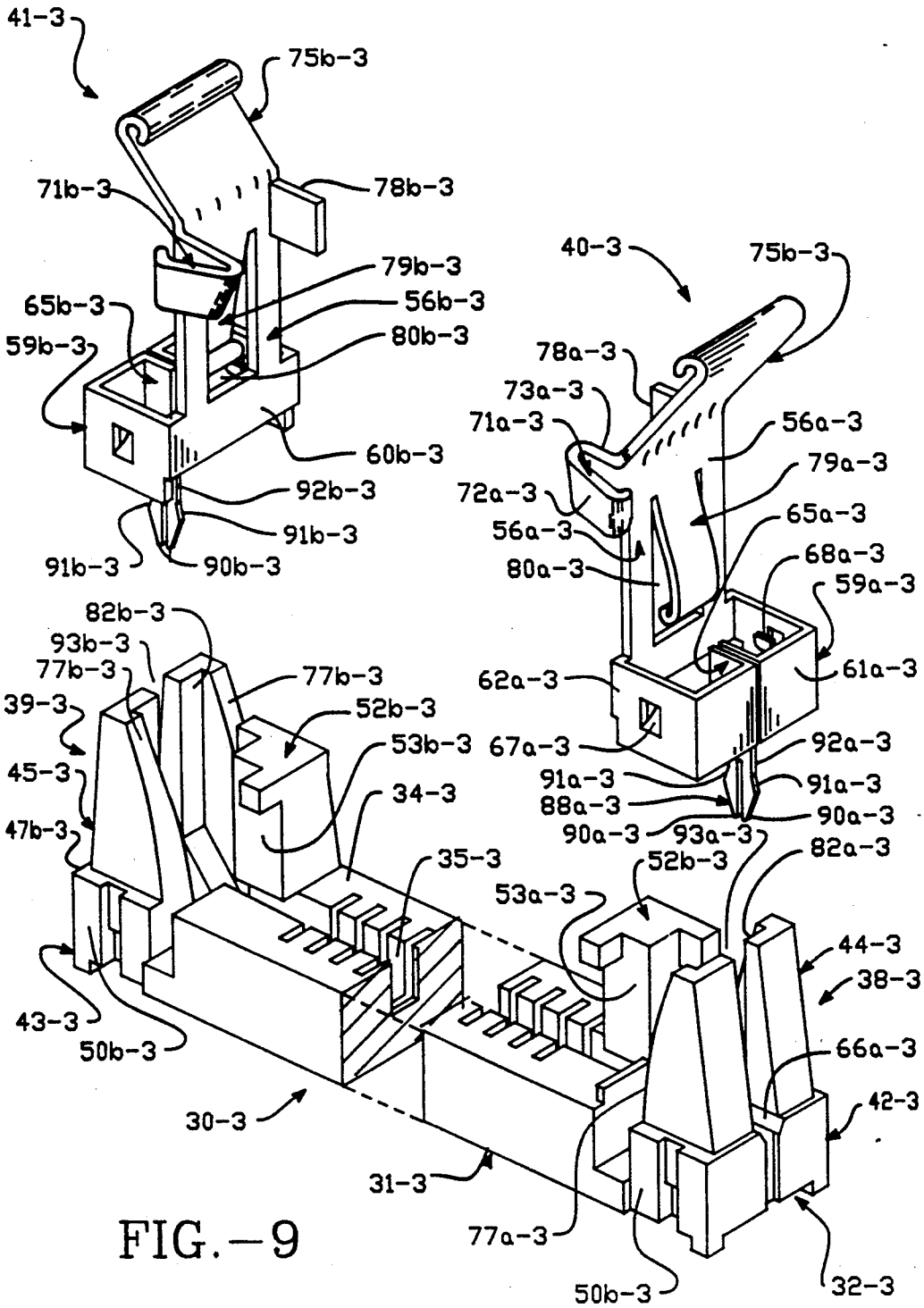
FIG. 9 is a fragmentary, top perspective view of another embodiment of the electrical connector assembly of the present invention which includes a primary circuit board mounting means.

FIG. 9 represents still another embodiment of the removable latches 40-3 and 41-3 of the present invention. In this alternative embodiment, however, the respective removable latches 40-3 and 41-3 which include the respective sleeve portion 59*a*-3 and 59*b*-3, also include a primary circuit board mounting means 88*a*-3 and 88*b*-3 extending vertically downward therefrom. Referring to first housing end 32-3, and corresponding latch 40-3, mounting means 88*a*-3 provide a means for releasably mounting the electrical connector 30-3 of the present invention to the primary circuit board (not shown). It will be appreciated that the mounting engaging means 88a-3 coupled to the latch 40-3 is appropriately positioned (discussed below) to replace the housing mounting post of the previous embodiments. Therefore, in this alternative latch embodiment 40-3, the electrical connector 30-3 may be more easily removed from the primary circuit board when desired. The respective sleeve portion 59a-3 is operative to securely engage the removable latch 40-3 to the connector housing 31-3, while the primary circuit board mounting means 88a-3 is operative to securely retain the first latch 40-3 and the entire housing 31-3 to the primary circuit board.

The board mounting means 88a-3 preferably comprises a downward extending, substantially planar engaging arm 92a-3 which includes a pair of aperture engaging fingers 90a-3. As can be seen in FIG. 9, the arm 92a-3 is coupled to the latch alignment edge 65a-3. To accommodate the arm 92a-3, the latch alignment edge 65a-3 protrudes further into the sleeve interior 64a-3 so that the respective mounting means 88a-3 may be affixed thereon.

Moreover, the support post 38-3 is modified to allow the mounting means 88a-3 to be positioned therethrough. A planar engaging means slot 93a-3 extends substantially through the support post 38-3 from the outermost rear wall 47a-3 in a direction inward toward the elongated board edge slot 35-3 and substantially parallel to the vertical slot plane. It will be appreciated that upon assembly of the latch 40-3 onto the support posts 38-3, the mounting means 88a-3 and the latch alignment edge 65a-3 will slidingly engage the engaging means slot 93a-3 to allow the base portion 42-3 to engage the sleeve portion 59a-3 of the latch 40-3. Thus, the aperture engaging fingers 90a-3 will protrude from the bottom of the housing 30-3 in a manner and position substantially similar to the housing mounting posts of the previous embodiments.

Each finger 90a-3 is inclined outward from its respective distal end such that an inward collapsing of the fingers 90a-3 is generated in response to forces exerted on the fingers as they are urged into an appropriately dimensioned mounting aperture (not shown) on the primary circuit board. Each respective finger 90a-3, further, includes locking surfaces 91a-3 for engaging a second surface of the primary circuit board opposite a first surface thereof on which the electrical connector 30-3 is positioned. Thus, as the respective fingers protrude through the mounting apertures located on the primary circuit board, the locking surfaces 91a-3 engage the second surface of the primary circuit board to releasably retain the electrical connector 30-3 to the primary circuit board.

The length of each respective mounting arm 92a-3 and 92b-3 is determined by the thickness of the primary circuit board. Thus, different board thicknesses can be accommodated by selecting the proper arm length.

Figure 10:
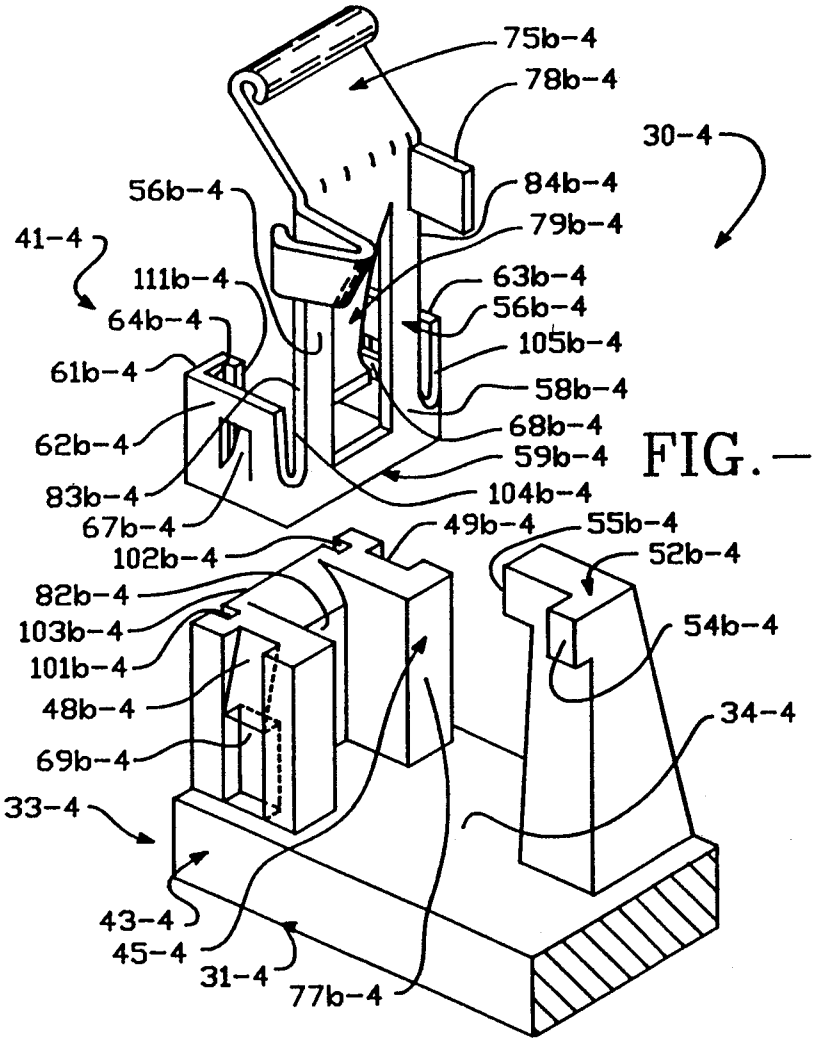
FIG. 10 is a fragmentary, top perspective view of an alternative embodiment of the present invention.

Another embodiment employing the sleeve portion mechanism of attachment to the housing end is illustrated in FIG. 10. In this embodiment, an alternative retainment mechanism is exhibited in which the respective sleeve portion 59b-4 of the latch 41-4 is removably mounted to, and aligned with, the housing 31-4 by the upper retaining portion 45-4, as compared to the base portion 43-4 of the previous embodiments. Therefore, the retaining portion 45-4 is dimensioned to insert into the respective sleeve portion 59b-4. Further, the respective first and second retainment slots 67b-4 and 68b-4, as well as the respective step portions 69b-4 and 70b-4 (not shown), are also defined by the upper retaining portion 45-4. Similarly, a first and a second vertical guidance slots 101b-4 and 102b-4 are defined by the upper retaining portion 45-4 disposed on a substantially vertical retaining portion rear wall 103b-4.

As shown in FIG. 10, the respective sleeve portion 59b-4 of the latch 41-4 remains coupled the bottom portion 58b-4 of the main body 56b-4. However, the sleeve portion 59b-4 extends upward from the bottom portion 58b-4, as opposed to extending downward, such that a first and a second sleeve gap 104b-4 and 105b-4 is formed between the edge of the respective first and second opposing sleeve side walls 62b-4 and 62b-4 and the respective first and second side edges 83b-4 and 84b-4 of the main body portion 56b-4. These respective sleeve gaps 104a-4 and 105b-4 permit the main body portion 56b-4 to move more freely into and out of the sleeve interior 64b-4. Moreover, a first and second substantially parallel latch alignment edge 111b-4 and 112b-4 (not shown) extend into the sleeve interior portion 64b-4 from the sleeve rear wall 61b-4.

The respective step portions 69b-4 and 70b-4 do not need to be positioned deeper into the backstop portion 45-4, as with the previous embodiments, in order to allow the respective barbs 67b-4 and 68b-4 to retainably engage therewith. As viewed in FIG. 10, the respective retaining slots 48b-4 and 49b-4 are inclined outward toward the respective sides of the backstop portion 45-4 to form the respective retaining step portions 69b-4 and 70b-4. Thus, the respective barbs 67b-4 and 68b-4 slide along the respective retaining slots 48b-4 and 49b-4 until they engage the respective step portions 69b-4 and 70b-4, thereby releasably retaining the latch 41-4 to the housing 31-4.

Accordingly, after assembly, when the respective sleeve portion 59b-4 snugly engages the retaining portion 45-4, the latch member 41-4 is removably secured to the housing 31-4 such that the retaining portion 4-43 provides adequate lateral support to retain the secondary circuit board in its operational position in electrical connector 30-4.

Figure 12:
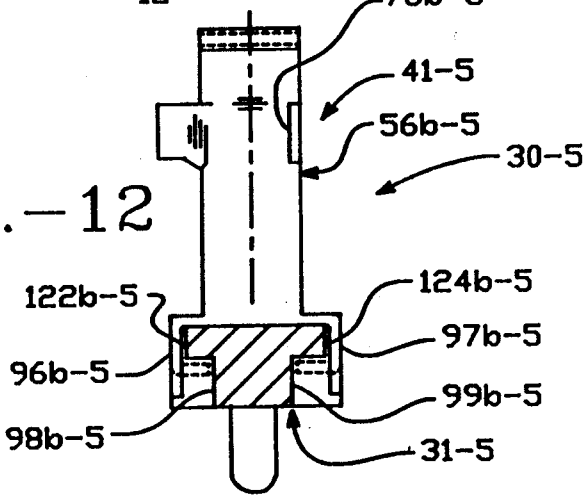
FIG. 12 is a vertical sectional view, taken substantially along the line 12—12 of FIG. 11, illustrating the staple mounting mechanism of the electrical connector assembly of FIG. 11.
Figure 11:
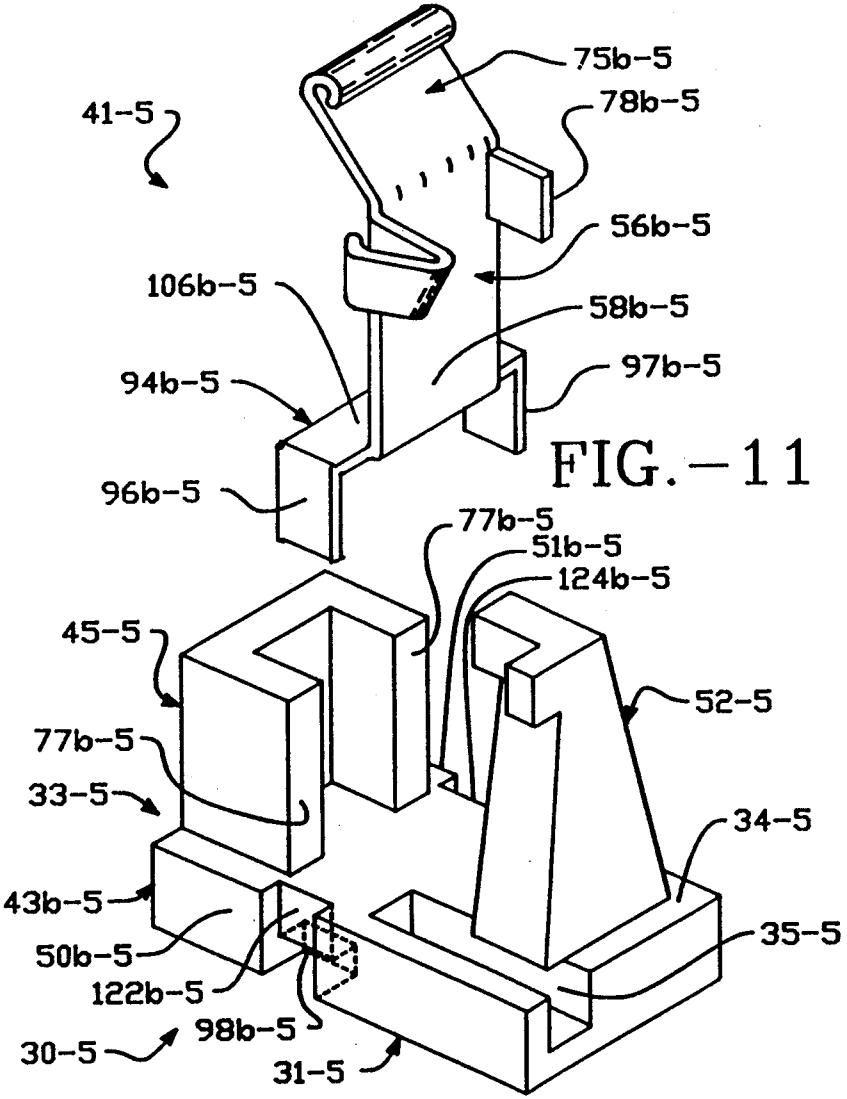
FIG. 11 is a fragmentary, top perspective view of an alternative embodiment of the present invention illustrating the staple mounting mechanism for attachment to the connector housing.

The next electrical connector represents the preferred mechanism of attachment to the insulative housing 31-5, as shown in FIG. 11. In this embodiment, the main body bottom portion 58b-5 of the latch 41-5 is coupled to a mounting platform 94b-5 which replaces the sleeve portions of the previous embodiments. As may be seen in FIGS. 11–13, the mounting platform 94b-4 is comprised of a substantially rectangular upper support plate 106b-4 which extends perpendicularly rearward from the main body bottom portion 58b-5 in the direction substantially parallel to the housing top side 34-5 in which it will supportably mate. Respective first and second mounting fingers 96b-5 and 97b-5 extend perpendicularly downward from the opposing side ends of the rectangular support plate 106b-5 in a direction substantially parallel to the respective first and second opposing base side walls 50b-5 and 51b-5 of the base portion 43-5. It will be appreciated that the first and second downwardly bent mounting fingers 96b-5 and 97b-5 are laterally spaced apart by a distance substantially equal to the cross-sectional width of the housing connector top side 34-5. The properly spaced apart first and second mounting fingers 96b-5 and 97b-5 assure that the mounting platform 94b-4 is snugly supported by the base portion 43-5 of the respective second support post 39-5, as illustrated in FIG. 12

The base portion 43-5 of the respective support post 39-5 defines respective first and second alignment finger grooves 122b-5 and 124b-5 disposed on the respective first and second opposing base side walls 50b-5 and 51b-55. These respective alignment finger grooves 122b-5 and 124b-5 are dimensioned to flushly receive the respective first and second mounting fingers 96b-5 and 97b-5 such that the respective fingers are seated an aligned. Thus, this helps align the respective latch 41 upon mounting to the housing 31-5 (discussed henceforth) and, further, provide lateral support when the secondary circuit board is mounted.

Figure 13:
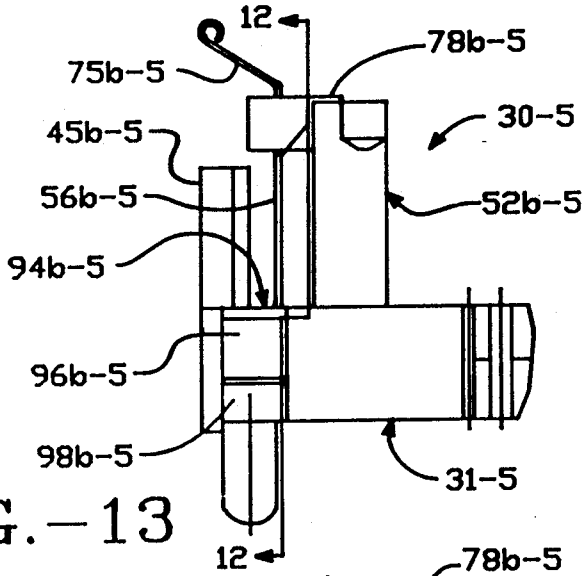
FIG. 13 is a fragmentary, side elevation view of the electrical connector assembly of FIG. 11.

Further, the first and second mounting finger slots 98b-5 and 99b-5 (not shown) are also disposed on the respective first and second opposing base side walls 50b-5 and 51b-55. These respective finger slots 98b-5 and 99b-5 are dimensioned to accept the respective first and second mounting fingers 96b-5 and 97b-5, as shown in FIGS. 12 and 13. Reminiscent of a staple, hence its name, the respective distal ends of the mounting fingers 96b-5 and 97b-5 are bent inward towards the respective first and second mounting finger slots 98b-5 and 99b-5, shown in the phantom lines in FIG. 12. This staple mounting mechanism simplifies installation and enhances lateral support to the latch 41-5 when the respective distal ends of the mounting fingers 96b-5 and 97b-5 engage the respective finger slots 98b-5 and 99b-5. Accordingly, the respective latch 41-5 is securely mounted to the second housing end 33-5.

The respective upstanding backstop portion 45-5 provides a rear latch backstop wall 77b-5 much like the previous embodiments.

Figures 14, 15, 18, 19, 20:
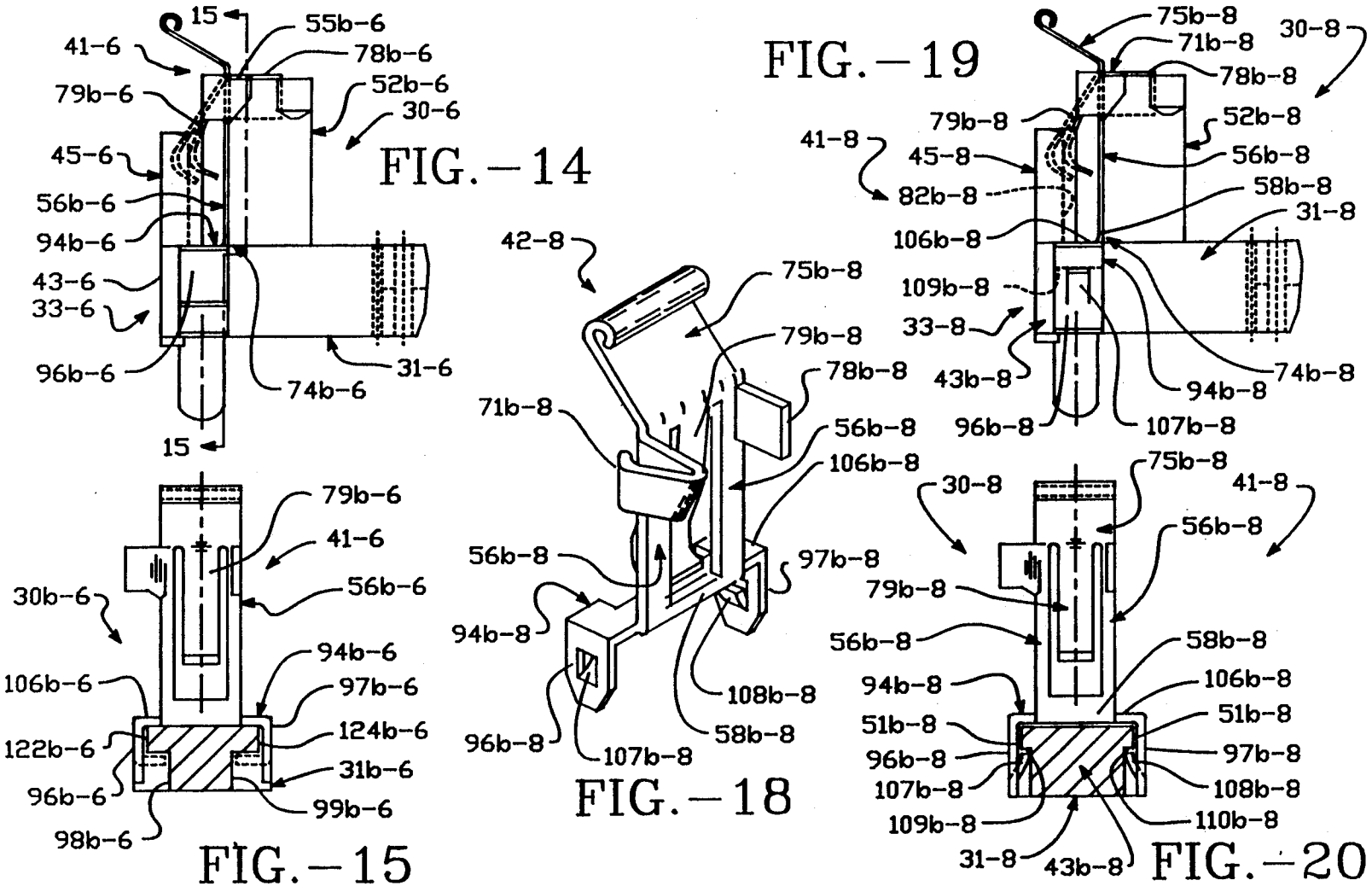
FIG. 14 is a fragmentary, side elevation view of the electrical assembly of FIG. 11 including a stress reducing arm.
FIG. 15 is a vertical sectional view, taken substantially along the line 15—15 of FIG. 14, illustrating the staple mounting mechanism of the electrical connector assembly of FIG. 14.
FIG. 18 is a top perspective view of an alternative latch embodiment illustrating the barbs of the mounting mechanism.
FIG. 19 is a fragmentary, side elevation view of the electrical connector assembly of FIG. 18.
FIG. 20 is a vertical sectional view, taken substantially along the line 19—19 of FIG. 19, of the electrical connector assembly of FIG. 19.

FIGS. 14 and 15 represent the preferred previous staple mounting mechanism embodiment which includes a stress reducing arm 79b-6. As with the previous embodiments, the stress reducing arm 79b-6, when engaged with the retaining wall 82b-6 of the upstanding retaining portion 45-6, decreases the stress concentration at the spring juncture 74b-6. This embodiment includes a latch front stop 55b-6 protruding toward the respective latch 41-6 from the rear circuit board support 52b-6 to prevent over-extension.

Figure 17:
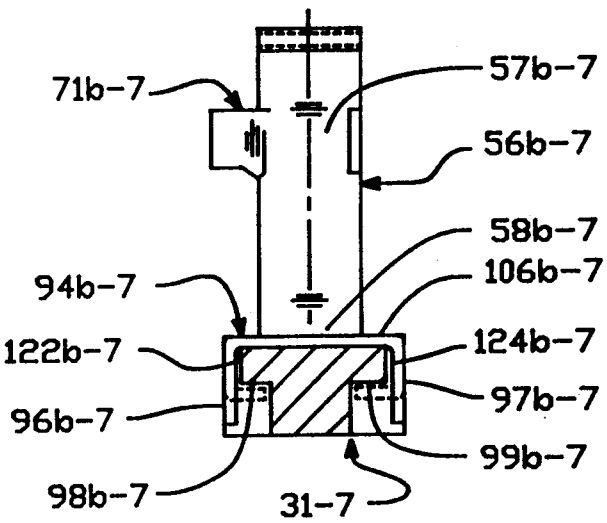
FIG. 17 is a vertical sectional view of the staple mounting mechanism of the electrical connector assembly of FIG. 16 illustrating the latch mounted to the housing.
Figure 16:
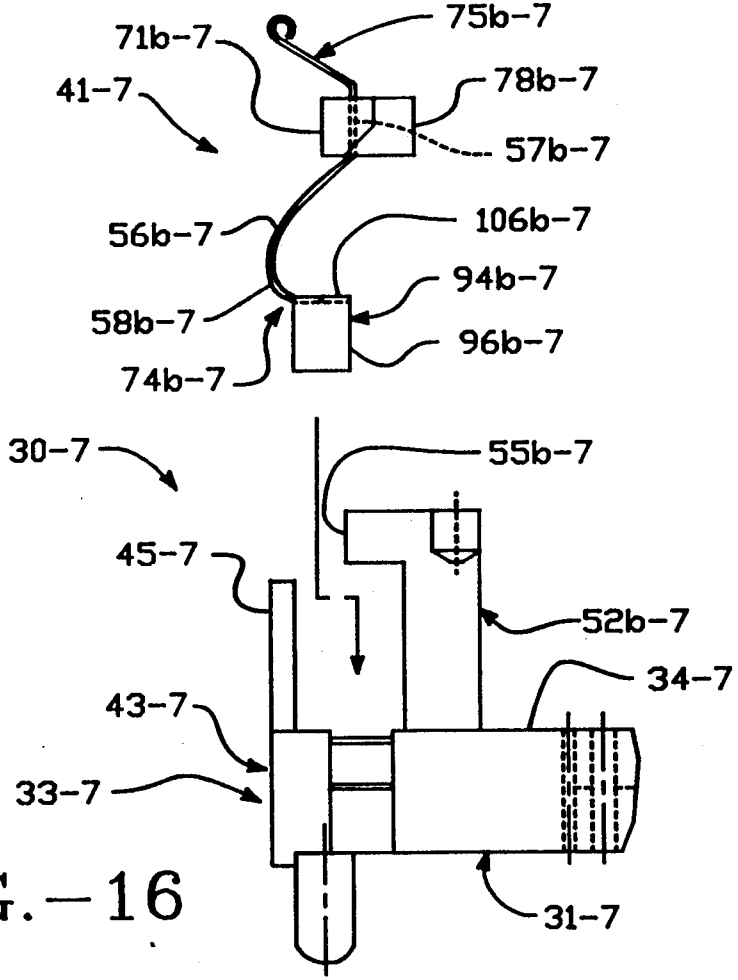
FIG. 16 is a fragmentary, side elevation view of another embodiment of the present invention employing the staple mounting mechanism.

Referring to FIGS. 16 and 17 an alternative main body portion 56b-7 is illustrated coupled to the mounting platform 94b-7. Unlike the previous embodiments, the main body portion 56b-7 of this embodiment is substantially curved, rather than planar. Thus, although the vertical height between the latch lug 71b-7 and the housing top side 34-7 remains substantially similar, the actual length of the main body portion 56b-7 is longer than the previous embodiments because of its curved positioning. This increased length enhances the overall flexibility of the main body portion 56b-7 which reduces stress concentration at spring juncture 74b-7. As will be described in greater detail below, this curvature and increased flexibility distributes the bending throughout the main body portion 56b-7 when the same is deflected rearward during installation or removal of the secondary circuit board.

As illustrated in FIG. 16, the mounting platform 94b-7 is mounted forward of the main body bottom side 58b-7, as opposed to being mounted rearward. Moreover, the bottom portion 58b-7 of the main body portion 56b-7 extends from the rectangular mounting support plate 106b-7 in a direction substantially parallel to the plate. In the previous latch embodiments, the main body portion extends substantially perpendicular therefrom. Thus, as the main body portion 56b-7 is displaced reward, the stress acting on the main body portion 56b-7 is absorbed all along the curvature. Accordingly, the bending stress is not narrowly concentrated at the spring juncture 74b-7 because it is distributed throughout the curvature of the main body portion 56b-7. This produces a result similar to the stress reducing arms, i.e., reducing stress at the spring juncture 74b-7, but in a different manner. Therefore, while according many of the benefits of a stress reducing arm, the curved main body portion 56b-7 of this latch embodiment 41-7 structurally simpler than embodiments employing the stress reducing arms.

The upper portion 57b-7 of the main body portion 56ab-7, however, remains substantially planar to promote planar engagement with the front latch stop 55b-7. Further, the backstop portion 45-7 which prevents latch overextension is simplified and substantially planar.

Another alternative mounting mechanism mounting the removable latches 40-8 (not shown) and 41-8 to the housing 31-8 is illustrated in the connector assembly 30-8 of FIGS. 18–20. Similar to the staple mounting mechanism of the previous embodiment, this mounting mechanism comprises a mounting platform 94b-8 which includes a rectangular support plate 106b-8 extending perpendicularly rearward from the main body bottom portion 58b-8. Again, respective first and second mounting fingers 96b-8 and 97b-8 extend perpendicularly downward from the opposing side ends of the rectangular support plate 106b-8.

However, in this mounting embodiment, the respective distal ends of the first and second mounting fingers 96b-8 and 97b-8 are not bent inward, respectively, toward one another. Rather, retainment is provided by first and second inwardly inclined barbs 107b-8 and 108b-8 which are defined by the respective first and second mounting fingers 96b-8 and 97b-8. These respective barbs 107b-8 and 108b-8 represent an uncomplicated mechanism for mounting the respective latch 41-8 to the respective second housing end 33-8.

As best illustrated in FIG. 19, the respective base portion 43-8 defines a respective first and second barb step 109b-8 and 110b-8 positioned oppositely on the respective first and second opposing base side walls 50b-8 and 51b-8. The first and second barb steps 109b-8 and 110b-8 are appropriately aligned and dimensioned to engage the corresponding first and second mounting finger barbs 107b-8 and 108b-8. Thus, after engagement with the respective steps 109b-8 and 110b-8, the respective latch 41-8 will be securely mounted to the respective housing end 33-8.

Figure 21:
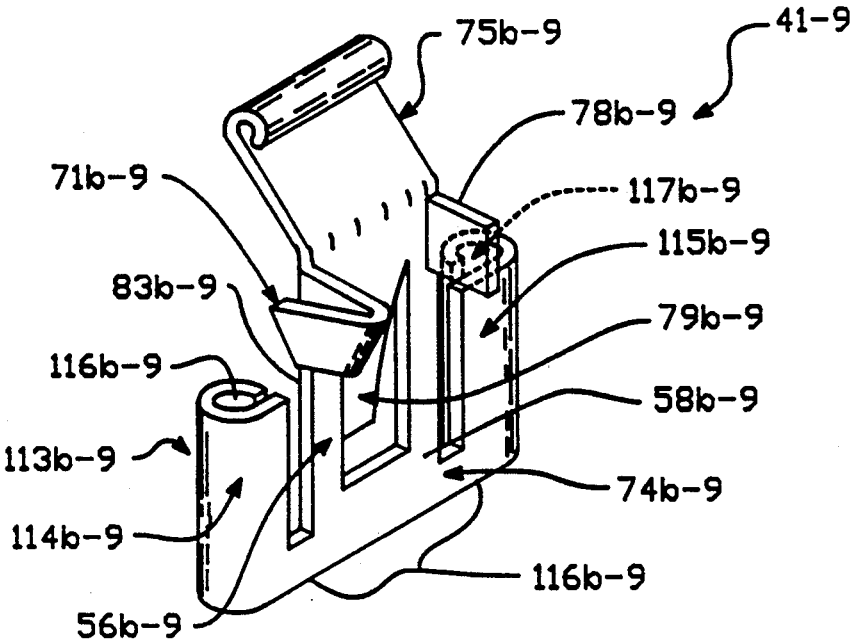
FIG. 21 is an enlarged top perspective view of an alternative latch embodiment illustrating the post receiving sleeves.

FIG. 21 represents yet another removable latch alternative embodiment mounting mechanism of the present invention. Coupled to the main body bottom portion 58b-9 of the removable latch 41-9 is a dual post receiving mounting mechanism 113b-9 which comprises respective first and second upstanding cylindrical sleeves 114b-9 and 115b-9 disposed adjacent the opposing first and second main body edges 83b-9 and 84b-9, respectively. As shown, the first and second cylindrical sleeves 114b-9 and 115b-9 are coupled together at the opposing longitudinal edges of a substantially vertical connecting plate 116b-9 positioned therebetween. Moreover, a top edge of the vertical connecting plate 116b-9 is coupled to the main body bottom portion 58b-9 which defines the respective spring juncture 74b-9.

The respective first and second cylindrical sleeves 114b-9 and 115b-9 are dimensioned to receive corresponding, respective first and second support posts (not shown) upstanding from the housing top side (not shown) of the respective second housing end (not shown). These respective first and second support posts are preferably inclined outward from the respective distal ends such that the respective first and second cylindrical sleeves 114b-9 and 115b-9 may be snugly mounted thereon. Positioned in the respective interior portions 116b-9 and 117b-9 of the respective first and second cylindrical sleeves 114b-9 and 115b-9 are retaining barbs (not shown) which releasably retain the latch 41-9 onto the respective support posts thereon. Moreover, these respective support posts provide lateral stability to the respective latches 40-9 (not shown) and 41-9 so that the secondary circuit board may be securely mounted in its operating position.

Figure 22:
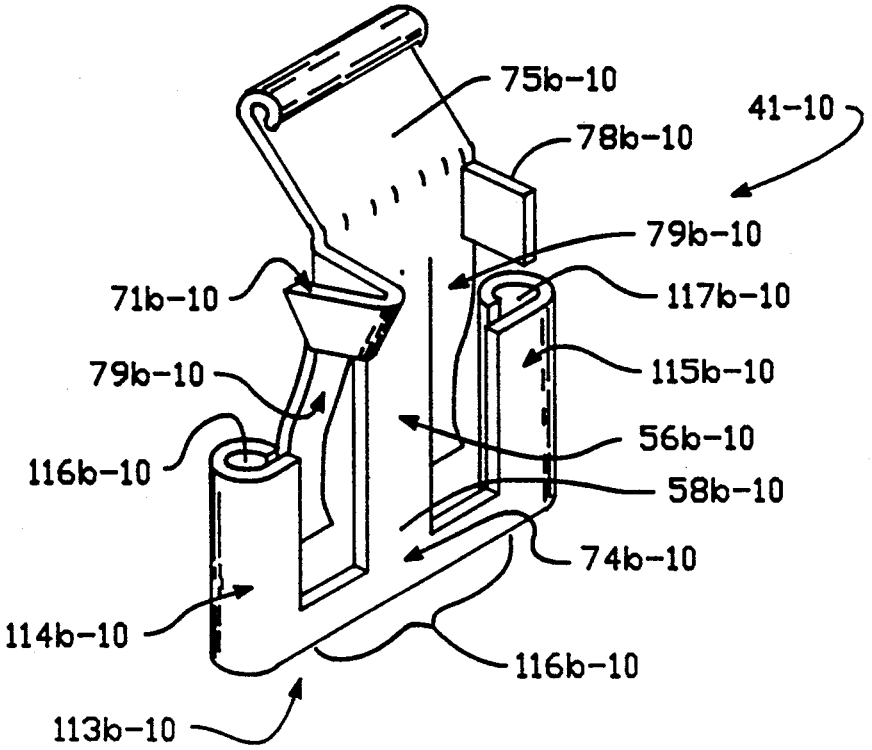
FIG. 22 is an enlarged top perspective view of the latch embodiment of FIG. 21 employing dual stress reducing arms.

Referring now to FIG. 22, as previously mentioned, this alternative latch 40-10 illustrates the dual post receiving mounting mechanism 113b-10 coupled to the main body portion 56b-10 including dual stress reducing arms 79b-10. Both of these components have been previously discussed in detail, and, thus, will not be repeated here.

Figures 23, 24:
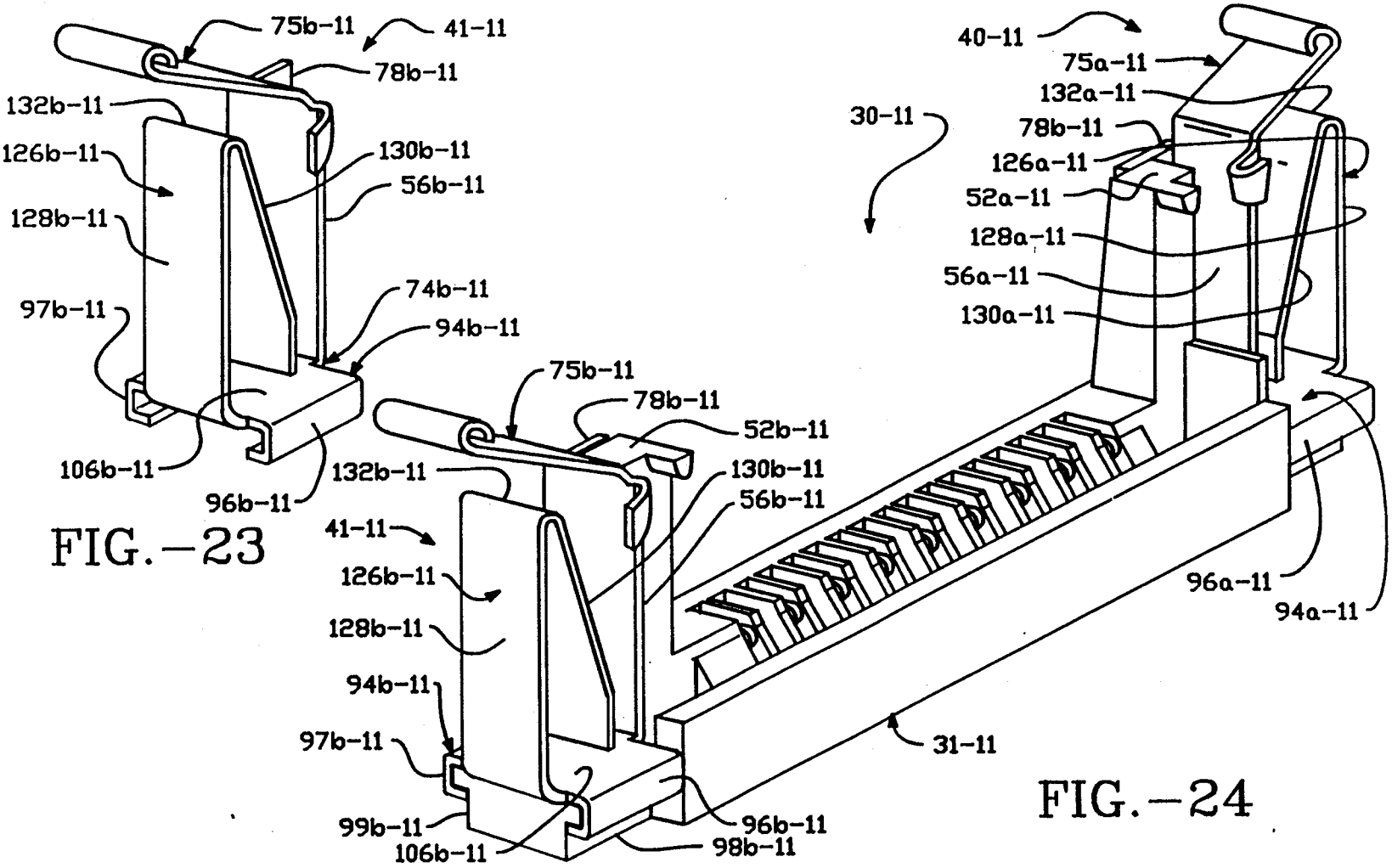
FIG. 23 is a top perspective view of another latch embodiment of the present invention employing the staple mounting mechanism which includes a resilient backstop support.
FIG. 24 is a top perspective view of a connector assembly employing the latches of FIG. 23.

Another alternative embodiment employing the staple mounting mechanism is illustrated in FIG. 23. As may be seen, the latch 41-11 includes a resilient backstop portion 126b-11 integrally coupled to the mounting platform 94b-11. Extending upward from the rear end of rectangular support plate 106b-11 is an upstanding resilient backstop support 128b-11. This support 128b-11 is substantially perpendicular to rectangular support plate 106b-11 and is mounted to the end opposite, but substantially parallel to, the main body portion 56b-11. Coupled to the upper distal end of resilient backstop support 128b-11 is a resilient backstop plate 130b-11 inclined downward toward the spring juncture 74b-11. The resilient backstop spring juncture 132b-11 between the upper distal end of resilient backstop support 128b-11 and the upper distal end of the resilient backstop plate 130b-11 form a resilient spring.

Therefore, the main body portion 56b-11 may be displaced reward until it engages the resilient backstop portion 128b-11. Upon engagement, the main body portion 56b-11 substantially contacts the resilient backstop plate 130b-11 which tensions the resilient backstop spring juncture 132b-11. This acts to urge the main body portion 56b-11 forward toward the respective board support post 52b-11, as shown in FIG. 24. Accordingly, not only does the resilient backstop portion 128b-11 provide a backstop to prevent overextension of the main body portion 56b-11, it also provides a backstop spring juncture 132b-11 which, together with the spring juncture 74b-11, urge main body portion 56b-11 forward.

FIG. 24 illustrates the connector assembly 30-11 with the first and second latches 40-11 and 41-11 mounted to the housing In the preferred form, the respective first and second mounting fingers 96b-11 and 97b-11 are wider than the previous staple mounting embodiments in order to provide better lateral support.

Figures 25, 26:
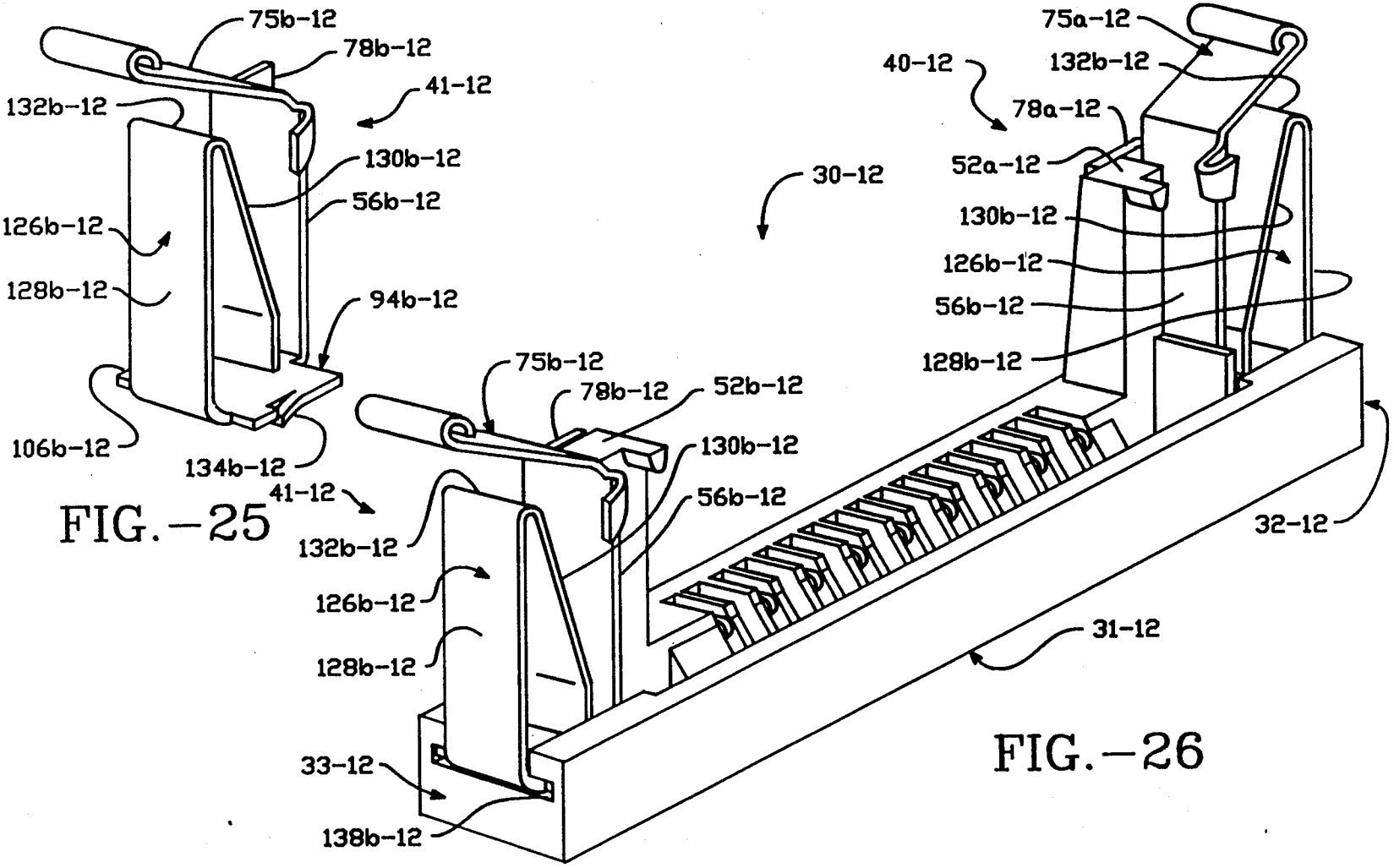
FIG. 25 is a top perspective view of another latch embodiment of the present invention including the resilient backstop support and employing an alternative mounting mechanism.
FIG. 26 is a top perspective view of a connector assembly employing the latches of FIG. 23.

Referring now to FIG. 25, an alternative mounting platform 94b-12 is coupled to the latch 41-12 including the resilient backstop portion 126b-12. As shown, the mounting platform 94b-12 does not include mounting fingers coupled to the ends of the rectangular support plate 106b-12. Rather, a first and a second support plate barb 134b-12 and 136b-12 (not shown), respectively, are provided to retainably mount the latch 41-12 to the connector housing 31-12. As shown in FIG. 26, the respective second housing end 33-12 defines a rectangular support plate mounting slot 138b-12 in which the respective rectangular support plate 106b-12 slidably engages. Respective first and second support plate barbs 134b-12 and 136b-12 engage the inner walls of the mounting slot 138b-12 to securely retain the latch 41-12 to the housing 31-12.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. An assembly for releasably securing a first circuit board comprising:

(A) a respective first latch and a respective second latch, each of said respective latches including
  (1) a respective main body portion,
  (2) a respective latch lug extending from said respective main body portion, each said respective latch lug including a respective cam surface inclined relative to said respective main body portion and a respective lock surface substantially perpendicular to said respective main body portion, and
  (3) a respective upstanding sleeve mounting member extending from said respective main body portion and including at least two respective retaining barbs extending into respective interior portions thereof;

(B) an in-line housing defining
  (1) an elongated slot,
  (2) a first support post disposed at one end of the slot and a second support post disposed at an opposite end of the slot, each of the respective support posts including
    (a) a respective base portion, and
    (b) a respective backstop portion upstanding from a top surface of said respective base portion;

(C) wherein each said respective sleeve mounting member is dimensioned to substantially envelope said respective base portion such that said respective first and second latches are secured onto the respective first and second support posts; and (D) wherein each said respective backstop portion is spaced apart from said respective main body portion such that said respective main body portion can be deflected toward said respective first and second support posts until said respective main body portions contact said respective backstop portion.

2. The connector assembly as defined in claim 1 wherein, said first and second latch each include a respective latch lever coupled to a respective top portion of said respective main body and respectively projecting angularly toward from said respective main body to form a respective cantilever projection therefrom.

3. The connector assembly as defined in claim 1 wherein, each of said respective base portions defines at least two respective recesses; and said respective retaining barbs are positioned to engage said respective recesses to fixedly mount said respective latches to said respective base portions.

4. The connector assembly as defined in claim 1 wherein, each of said respective sleeve mounting members includes at least one respective alignment edge extending into respective interior portions of said respective sleeve mounting members.

5. The connector assembly as defined in claim 1 wherein, each of said respective base portions defines at least one alignment groove; and each of said respective sleeve mounting members includes at least one respective alignment edge extending into respective interior portions of said respective sleeve mounting members, said respective at least one alignment edge being positioned to engage said respective at least one alignment groove to slidably align said respective sleeve mounting member to said respective base portions.

6. The connector assembly as defined in claim 1 wherein, each of said respective backstop portions defines a respective curved surface dimensioned to contact said respective main body portions.

7. The connector assembly as defined in claim 1 wherein, each of said respective base portions includes respective circuit board mounting means for releasably mounting the respective first and second latch and the housing to a second circuit board.

8. The connector assembly as defined in claim 7 wherein, each of said respective circuit board mounting means comprises a respective pair of deflectable board engaging fingers for securely engaging respective mounting apertures defined in the second circuit board.

9. An assembly for releasably securing a circuit board comprising:

(A) a respective first latch and a respective second latch, each of said respective latches including (1) a respective main body portion, (2) a respective latch lug extending from said respective main body portion, each said respective latch lug including a respective cam surface inclined relative to said respective main body portion and a respective lock surface substantially perpendicular to said respective main body portion, and (3) a respective upstanding sleeve mounting member extending from said respective main body portion and including at least two respective retaining barbs extending into respective interior portions thereof;

(B) an in-line housing defining (1) an elongated slot, (2) a first backstop portion disposed at one end of the slot and a second backstop portion disposed at an opposite end of the slot, each respective backstop portion defining at least two respective recesses;

(C) wherein each said respective sleeve mounting member is dimensioned to substantially envelope said respective first and second backstop portions such that said respective first and second latches are releasably secured onto the respective first and second backstop portions, and said respective retaining barbs are positioned to engage said respective recesses to fixedly mount said respective latches to said respective first and second backstop portions; and (D) wherein a top portion of each said respective backstop portion is spaced apart from said respective main body portion such that said respective main body portion can be deflected toward said respective top portions until said respective main body portions substantially contact said respective backstop portions.

10. The connector assembly as defined in claim 9 wherein, each of said respective backstop portions defines at least one alignment groove; and each of said respective sleeve mounting members includes at least one respective alignment edge extending into respective interior portions of said respective sleeve mounting members, said respective at least one alignment edge being positioned to engage said respective at least one alignment groove to slidably align said respective sleeve mounting member to said respective backstop portions.

11. The connector assembly as defined in claim 9 wherein, said first and second backstop portions each defines respective channels which include respective retaining walls facing said respective main body portions; and each of said first and second latches includes stress reducing means, each including a respective resilient arm projecting angularly away from said respective main body portion toward the respective retaining walls such that said respective arm more forcibly contacts the respective retaining wall when said main body portion is deflected toward said respective backstop portions.

12. An assembly for releasably securing a circuit board comprising:

(A) an elongated in-line housing including a first side wall, an opposing second side wall and a top side, said housing defining (1) an elongated slot disposed on the top side, (2) a first and a second housing recess positioned proximate one end of the slot, the first housing recess disposed on the first housing side wall and the second housing recess oppositely disposed on the second housing side wall, (3) a third and a fourth housing recess positioned proximate an opposite end of the slot, the third housing recess disposed on the first housing side wall and the fourth housing recess oppositely disposed on the second housing side wall, (4) a first backstop portion disposed at one end of the slot and a second backstop portion disposed at the opposite end of the slot, and said respective first and second backstop portions each defines a respective channel which include a respective retaining wall facing said elongated slot;

(B) a respective first latch and a respective second latch, each of said respective latches including (1) a respective main body portion, (2) a respective latch lug extending from said respective main body portion, each said respective latch lug including a respective cam surface inclined relative to said respective main body portion and a respective lock surface substantially perpendicular to said respective main body portion, (3) a respective mounting platform each of which includes a respective plate extending from said respective main body portions, and a respective first finger extending substantially downward from one end of said plate and a respective second finger extending substantially downward from the opposite end of said plate, each respective first and second finger of said respective first and second latch includes housing mounting means, and (4) respective stress reducing means each including a resilient arm projecting angularly away from said respective main body portion toward said respective backstop retaining wall; p1 (C) wherein said respective mounting platform of said respective first latch straddles said housing such that said respective mounting means of said first and second fingers securely engage said first and second recesses, respectively;

(D) wherein said respective mounting platform of said respective second latch straddles said housing such that said respective mounting means of said first and second fingers each securely engages said first and second recesses, respectively; and (E) wherein said respective resilient arm more forcibly contacts said respective retaining wall when said main body portion is deflected toward said respective backstop portion.

13. The connector assembly as defined in claim 12 wherein, said respective mounting means of respective first and second fingers of said first latch each comprise deformable distal ends dimensioned to be deformed into and securely engage with said first and second housing recesses, respectively, and said respective mounting means of respective first and second fingers of said second latch each comprise deformable distal ends dimensioned to be deformed into and securely engage with said third and fourth housing recesses, respectively.

14. The connector assembly as defined in claim 12 wherein, said respective mounting means of respective first and second fingers of said first latch each comprise a respective first and second mounting barb dimensioned to securely engage with said first and second housing recesses, respectively, and said respective mounting means of respective first and second fingers of said second latch each comprise a respective third and fourth mounting barb dimensioned to securely engage with said third and fourth housing recesses, respectively.

15. The connector assembly as defined in claim 12 wherein, said first and second latch each include a respective latch lever coupled to a respective top portion of said respective main body portion and respectively projecting angularly outward from said respective main body portion to form a respective cantilever projection therefrom.

16. The device as defined in claim 12 wherein, each distal end of said respective resilient arm is respectively curved toward said respective main body portion.

17. The connector assembly as defined in claim 12 wherein, the respective main body portions of said first and second latches is substantially curved.

18. The connector assembly as defined in claim 12 wherein, each of said respective main body portions includes a respective guidance latch plate extending toward the elongated slot of said housing.

19. The connector assembly as defined in claim 12 wherein, (A) said housing includes (1) a first upstanding circuit board support post disposed proximate one end of the elongated slot adjacent the first backstop portion such that said respective main body portion of said first latch is positioned between the first backstop portion and the first circuit board support post, and (2) a second upstanding circuit board support post disposed proximate the opposite end of the elongated slot adjacent the second backstop portion such that the respective main body portion of said second latch is positioned between the second backstop portion and the second circuit board support post.

20. The connector assembly as defined in claim 19 wherein, each first and second circuit board support post includes respective latch frontstops respectively extending toward the respective first and second backstop portions; and each of said respective stress reducing arms urge said respective main body portions against the respective latch frontstops.

21. The connector assembly as defined in claim 12 wherein, a first alignment means disposed at one end of the slot for aligning said first latch with the slot; and a second alignment means disposed at the opposite end of the slot for aligning said second latch with the slot.

22. The connector assembly as defined in claim 21 wherein, the first alignment means comprises a first groove and a second groove defined by said first side wall and said second opposing side wall, respectively, said first and second grooves being dimensioned to alignably receive said first and second fingers, respectively; and the second alignment means comprises a groove third and a fourth groove defined by said first side wall and said second opposing side all, respectively, said third and fourth grooves being dimensioned to alignably receive said first and second fingers, respectively.

23. An assembly for releasably securing a circuit board comprising:

(A) an elongated in-line housing including a first housing end wall, an oppositely disposed second housing end wall and a top side, said housing defining (1) an elongated slot disposed on the top side between the first and second housing end walls, (2) a first mounting slot disposed on the first housing end wall, and (3) a second mounting slot disposed on the second housing end wall;

(B) a respective first latch and a respective second latch, each of said respective latches including (1) a respective main body portion, (2) a respective latch lug extending from said respective main body portion, each said respective latch lug including a respective cam surface inclined relative to said respective main body portion and a respective lock surface substantially perpendicular to said respective main body portion, (3) a respective mounting platform each of which includes a respective plate extending from said respective main body portion, said respective plate each including a first side and an oppositely disposed second side, and a respective first slot guide flange extending outward from the first side away from said main body portion and a respective second slot guide flange extending outward from the second side away from said main body portion, said respective first and second slot guide flanges of said respective first and second latches being dimensioned to slidably engage the first and second mounting slots, respectively; and (4) each first and second latch includes a respective backstop portion comprising a respective backstop support member upstanding from said respective mounting platform, and a respective backstop plate member extending angularly downward toward said respective main body portion from and resiliently coupled to a respective upper distal end of said respective backstop support member.

24. The connector assembly as defined in claim 23 wherein, each of said respective first and second slot guide flanges include respective barbs formed to retainably engage said respective first and second slot guide flanges in the respective first and second mounting slots.

25. The connector assembly as defined in claim 23 wherein, said first and second latch each includes a respective latch lever coupled to a respective top portion of said respective main body and respectively projecting angularly outward from said respective main body to form a respective cantilever projection therefrom.

26. The connector assembly as defined in claim 23 wherein, (A) said housing includes (1) a first upstanding circuit board support post disposed proximate one end of the elongated slot adjacent the respective backstop portion of said first latch such that the respective main body portion of said first latch is positioned between the respective backstop portion and the first circuit board support post, and (2) a second upstanding circuit board support post disposed proximate the opposite end of the elongated slot adjacent the respective backstop portion of said second latch such that the respective main body portion of said second latch is positioned between the respective backstop portion and the second circuit board support post.

27. The connector assembly as defined in claim 26 wherein, each first and second circuit board support post includes respective latch frontstops respectively extending toward the respective main body portions of said first and second latches.

28. The connector assembly as defined in claim 26 wherein, each first and second circuit board support post includes respective latch frontstops respectively extending toward the respective main body portions of said first and second latches; and each of said respective main body portions includes a respective guidance latch plate extending toward said respective first and second board support posts such that when said respective main body portions are deflected away from the respective first and second board support posts, said respective latch plates slidably engage said respective latch frontstops.

29. An assembly for releasably securing a circuit board comprising:

(A) a first latch and a second latch, each respective latch including (1) a main body portion, (2) a latch lug, extending from said main body portion, including a cam surface inclined relative to said main body portion and a lock surface substantially perpendicular to said main body portion, and (3) an upstanding sleeve mounting member extending from said main body portion and including at least one alignment edge extending into an interior portion thereof;

(B) an in-line housing defining (1) an elongated slot, (2) a first support post disposed at one end of the slot and a second support post disposed at an opposite end of the slot, each respective support post including a base portion having at least one alignment groove, and a backstop portion upstanding from a top surface of said respective base portion;

(C) each respective sleeve mounting member is dimensioned to substantially envelope said respective base portion, and each respective at least one alignment edge being positioned to engage said respective at least one alignment groove to slidably align said respective sleeve mounting member to said respective base portion such that said respective latch is secured onto the respective support post; and (D) each respective backstop portion is spaced apart from said respective main body portion such that said respective main body portion can be deflected toward said respective support post until said respective main body portion contacts said respective backstop portion.

30. An assembly for releasably securing a circuit board comprising:

(A) an in-line housing defining (1) an elongated slot, (2) a first support post disposed at one end of the slot and a second support post disposed at an opposite end of the slot, each respective support post including a base portion, and a backstop portion upstanding from a top surface of said respective base portion, said backstop portion defining a channel which includes a retaining wall facing toward the elongated slot;

(B) a first latch and a second latch, each respective latch including
(1) a main body portion,
(2) a latch lug, extending from said main body portion, including a cam surface inclined relative to said main body portion and a lock surface substantially perpendicular to said main body portion,
(3) an upstanding sleeve mounting member extending from said main body portion, and
(4) stress reducing means including a resilient arm projecting angularly away from said main body portion toward said respective backstop retaining wall;
(C) each respective sleeve mounting member is dimensioned to substantially envelope said respective base portion such that said respective latch is secured onto the respective support post; and
(D) each respective backstop portion is spaced apart from said respective main body portion such that said respective main body portion can be deflected toward said respective support post until said respective main body portion contacts said respective backstop portion, and
(E) each respective resilient arm more forcibly contacts the respective backstop retaining wall when said respective main body portion is deflected toward said respective backstop portion.

31. The device as defined in claim 30 wherein,
each distal end of said respective resilient arm is respectively curved toward said respective main body portion.

32. The connector assembly as defined in claim 30 further including:
a first upstanding first circuit board support post disposed proximate one end of the elongated slot adjacent the first support post such that the respective main body portion of the first latch is positioned between the first support post and the first board support post; and
a second upstanding first circuit board support post disposed proximate the opposite end of the elongated slot adjacent the second support post such that the respective main body portion of the second latch is positioned between the second support post and the second circuit board support post.

33. The connector assembly as defined in claim 32 wherein,
each first and second board support posts includes respective latch frontstops respectively extending toward the respective first and second support post; and
each of said respective stress reducing arms urge said respective main body portions against respective the latch frontstops.

34. An assembly for releasably securing a circuit board comprising:
(A) a first latch and a second latch, each of said respective latches including
(1) a main body portion,
(2) a latch lug extending from said main body portion, each said latch lug including a cam surface inclined relative to said main body portion and a lock surface substantially perpendicular to said main body portion, and
(3) an upstanding sleeve mounting member extending from said main body portion;
(B) an in-line housing defining
(1) an elongated slot,
(2) a first support post disposed at one end of the elongated slot and a second support post disposed at an opposite end of the elongated slot, each respective support post including a base portion, and a backstop portion upstanding from a top surface of said respective base portion,
(3) a first upstanding circuit board support post disposed proximate said one end of the elongated slot adjacent the first support post and a second upstanding circuit board support post disposed proximate said opposite end of the elongated slot adjacent the second support post such that each respective latch main body portion is positioned between the respective support post and the respective board support post, and each respective board support post further including a latch frontstop respectively extending toward the respective support post;
(C) each respective sleeve mounting member is dimensioned to substantially envelope said respective base portion such that the respective latches are secured onto the respective support posts;
(D) each respective backstop portion is spaced apart from the respective main body portion such that said respective main body portion can be deflected toward the respective support post until the respective main body portion contacts the respective backstop portion; and
(E) each said respective main body portion includes a guidance latch plate extending toward the respective board support post such that when the respective main body portion is deflected away from the respective board support post, said respective latch plate slidably engage said respective latch frontstop.

35. The connector assembly as defined in claim 34 wherein,
each of said respective backstop portions define respective channels which include respective retaining walls facing the respective main body portions; and
each of said first and second latches includes stress reducing means, each including a respective resilient arm projecting angularly away from said respective main body portions toward the respective retaining walls such that said respective arms more forcibly contact the respective retaining walls when said main body portions are deflected away from said respective first and second board posts.

36. An assembly for releasably securing a circuit board comprising:
(A) an elongated in-line housing including a first side wall, an opposing second side wall and a top side, said housing defining
(1) an elongated slot disposed on the top side,
(2) a first and a second housing recess positioned proximate one end of the slot, the first housing recess disposed on the first housing side wall and the second housing recess oppositely disposed on the second housing side wall, and
(3) a third and a fourth housing recess positioned proximate an opposite end of the slot, the third housing recess disposed on the first housing side wall and the fourth housing recess oppositely disposed on the second housing side wall;
(B) a respective first latch and a respective second latch, each of said respective latches including (1) a respective main body portion, (2) a respective latch lug extending from said respective main body portion, each said respective latch lug including a respective cam surface inclined relative to said respective main body portion and a respective lock surface substantially perpendicular to said respective main body portion, and (3) a respective mounting platform each of which includes a respective plate extending from said respective main body portions, and a respective first finger extending substantially downward from one end of said plate and a respective second finger extending substantially downward from the opposite end of said plate, each respective first and second finger of said respective first and second latch includes housing mounting means, (4) each first and second latch includes a respective backstop portion comprising a respective backstop support member upstanding from said respective mounting platform, and a respective backstop plate member extending angularly downward toward said respective main body portion from and resiliently coupled to a respective upper distal end of said respective backstop support member;

(C) wherein said respective mounting platform of said respective first latch straddles said housing such that said respective mounting means of said first and second fingers securely engage said first and second recesses, respectively; and (D) wherein said respective mounting platform of said respective second latch straddles said housing such that said respective mounting means of said first and second fingers each securely engages said first and second recesses, respectively.

37. The connector assembly as defined in claim 36 wherein, (A) said housing includes (1) a first upstanding circuit board support post disposed proximate one end of the elongated slot adjacent the respective backstop portion of said first latch such that the respective main body portion of said first latch is positioned between the respective backstop portion and the first circuit board support post, and (2) a second upstanding circuit board support post disposed proximate the opposite end of the elongated slot adjacent the respective backstop portion of said second latch such that the respective main body portion of said second latch is positioned between the respective backstop portion and the second circuit board support post.

38. The connector assembly as defined in claim 37 wherein, each first and second circuit board support post includes respective latch frontstops respectively extending toward the respective main body portions of said first and second latches.

39. The connector assembly as defined in claim 37 wherein, each first and second circuit board support post includes respective latch frontstops respectively extending toward the respective main body portions of said first and second latches; and each of said respective main body portions includes a respective guidance latch plate extending toward said respective first and second board support posts such that when said respective main body portions are deflected away from the respective first and second board support posts, said respective latch plates slidably engage said respective latch frontstops.

* * * * *

UNITED STATES PATENT AND TRADEMARK OFFICE

CERTIFICATE OF CORRECTION

PATENT NO. : 5,286,217

DATED : February 15, 1994

INVENTOR(S) : Chao J. Liu, et al.

It is certified that error appears in the above-identified patent and that said Letters Patent is hereby corrected as shown below:

Column 6, line 37, after "52a" insert a period --.--.

Column 7, line 1, after "rearward" insert a period --.--.

Col. 11, line 54, after "bending" insert --stress--.

Col. 13, line 55, after "housing" insert --31-11.--.

Col. 17, claim 12, line 17, delete "p1" and make (C) a new paragraph.

Signed and Sealed this

Twenty-sixth Day of July, 1994

Bruce Lehman

*Attest:*

BRUCE LEHMAN

*Attesting Officer*

*Commissioner of Patents and Trademarks*